US007017513B2

(12) United States Patent
Giewercer

(10) Patent No.: US 7,017,513 B2
(45) Date of Patent: Mar. 28, 2006

(54) DOSAGE REMINDER DEVICE AND MEDICATION CARTON

(76) Inventor: Harry Giewercer, 29 Hyde Park Drive, Richmond Hill, Ontario (CA) L4B 1V2

( * ) Notice: Subject to any disclaimer, the term of this patent is extended or adjusted under 35 U.S.C. 154(b) by 0 days.

(21) Appl. No.: 10/212,761

(22) Filed: Aug. 7, 2002

(65) Prior Publication Data

US 2003/0029374 A1 Feb. 13, 2003

Related U.S. Application Data

(60) Provisional application No. 60/310,501, filed on Aug. 8, 2001.

(51) Int. Cl.
*G09F 9/40* (2006.01)

(52) U.S. Cl. ..... 116/308; 116/312; 116/319; 116/324

(58) Field of Classification Search ..... 206/459.1, 206/534; 40/495, 484; 283/103, 104, 105, 283/106; 116/308, 309, 311, 312, 317, 318, 116/307, 313, 314, 315, 319, 320, 321, 322, 116/323, 324; 229/116.1
See application file for complete search history.

(56) References Cited

U.S. PATENT DOCUMENTS 332,208 A * 12/1885 Noel ..... 116/308
579,474 A * 3/1897 De Barry ..... 116/308
596,646 A * 1/1898 Altshul ..... 215/365
711,240 A * 10/1902 Zaring ..... 40/306
1,211,737 A * 1/1917 Martini ..... 116/308
1,770,222 A * 7/1930 Van Houten ..... 198/449
2,033,998 A * 3/1936 Prager ..... 206/103
2,222,166 A * 11/1940 Beline ..... 116/324
2,593,868 A * 4/1952 Fowler ..... 215/12.1
2,738,760 A * 3/1956 Myers ..... 116/321
2,866,433 A * 12/1958 Kallick et al. ..... 116/324
3,032,003 A * 5/1962 Lambert et al. ..... 116/311
3,034,639 A * 5/1962 Fuerste ..... 206/265
3,180,310 A * 4/1965 Giebel ..... 116/309
3,199,231 A * 8/1965 Ruderian ..... 434/404
3,347,204 A * 10/1967 Beall ..... 116/312
3,638,603 A * 2/1972 Conover ..... 116/308
3,829,003 A * 8/1974 Dilot ..... 229/120.38
3,996,879 A * 12/1976 Walton ..... 116/308
4,285,428 A * 8/1981 Beddall et al. ..... 206/354
4,328,895 A * 5/1982 Jaeger ..... 206/496
4,413,730 A * 11/1983 Morse ..... 206/232
4,557,215 A * 12/1985 Petersson ..... 116/222
4,712,504 A * 12/1987 Zarley et al. ..... 116/222
4,805,775 A * 2/1989 Fear ..... 206/459.1
4,860,684 A * 8/1989 Al-Harbi ..... 116/308
4,922,850 A * 5/1990 Conley ..... 116/222
5,353,439 A * 10/1994 Kurtz et al. ..... 2/160
5,374,461 A * 12/1994 Bromberg ..... 428/43
5,447,769 A * 9/1995 Bromberg ..... 428/66.6
5,482,163 A * 1/1996 Hoffman ..... 206/534

(Continued)

*Primary Examiner*—R. Alexander Smith

(57) ABSTRACT

A dosage reminder device (100) and medication carton (130) includes an indicator/support (140) formed from the carton's flat exterior wall (132) retentively engaging a rotateable ring (110). The ring includes dosage time period indicia (118) establishing (120) a dosage schedule and the indicator includes a co-operating next dose pointer (146) for selecting the next dosage time period so indicated. A patient can rotate the ring to align the next scheduled dosage time period with the indicator pointer. The indicator pointer and the scheduled dosage time period form a reminder indicating when the next dose is due or when the last dose was taken.

23 Claims, 28 Drawing Sheets

U.S. PATENT DOCUMENTS 5,489,122 A * 2/1996 Pittner ..... 283/49
5,752,235 A * 5/1998 Kehr et al. ..... 705/3
5,979,698 A * 11/1999 Deal ..... 221/2
6,032,609 A * 3/2000 Luoma ..... 116/306
6,152,067 A * 11/2000 Mathison ..... 116/308
2005/0183982 A1* 8/2005 Giewercer ..... 206/534

* cited by examiner

DOSAGE REMINDER DEVICE AND MEDICATION CARTON

CROSS-REFERENCE TO RELATED APPLICATIONS

This application is based upon provisional application No. 60/310,501 filed on Aug. 8, 2001.

BACKGROUND

1. Field of Invention

The present invention relates to a device for reminding a patient to take his next dose of medication as well as a carton container, which is intended especially for medication. More specifically, the invention provides medication packaging with a simple visual representation of the patient's dosage schedule for a particular medication, and when the next dose is due or when the last dose was taken.

2. Discussion of Prior Art

Devices and methods to help patients follow a medication regimen are not a new phenomenon. On Dec. 8, 1885, U.S. Pat. No. 332,208 was granted to J. S. Noel for a "TIME DOSE-INDICATOR FOR BOTTLES", consisting of a series of dials and a window. Even at that time his invention offered new and useful improvements over previous designs. More complex and costlier devices and means are also described in the art. For example, U.S. Pat. No. 5,752,235 granted to Kehr, et al. on May 12, 1998 for an, "ELECTRONIC MEDICATION MONITORING AND DISPENSING METHOD" describes a device having a plurality of compartments for storing medication and an electrical signaling system to emit medication alert signals from time to time.

Other recent devices seek to replace commonly used containers with elaborate designs. For example, U.S. Pat. No. 5,482,163 granted to Kenneth L. Hoffman on Jan. 9, 1996 for a, "LAST EVENT INDICATOR" describes a device consisting of a cylindrical container and an expandable indicator ring disposed over the cylinder's outer surface. All embodiments of the invention would cost more than vials in use today and would necessitate the production of numerous sizes. The investment in tooling alone would be considerable.

Available specialized blister card and dial type medication packaging which include a plurality of pill cavities can offer a reminder by way of indicia referencing individual pill cavities. However, such packaging is relatively costly to produce and normally requires separate tooling for each pill size. Such packages are viable in a treatment area like contraception because of limited universal dosage regimens. That is usually not possible for other medications. The cost of the reminder is directly tied to the number of pills dispensed. Furthermore the space occupied by a method which positions each pill in a discrete separated location can be considerably more than bulk packaging. Loading such packages with medication is also more costly. These limitations have negatively impacted the increased use of such packaging.

Some reminder devices that work with standard medication containers exist in the art, however they do not seem to have become widely available. It is believed that these prior devices have shortcomings such as undue complexity, cost of manufacture, applicability to few containers and requirement of special skills. Failing to provide for simple customization by the patient or Pharmacist has also been an obstacle to acceptance, because it resulted in a device of limited application or necessitated the production of a great variety of devices. The devices, for the most part, also seem to be designed for use with prescription vials.

For example, a typical invention for use on vials, U.S. Pat. No. 3,996,879 granted to Vilma E. Walton on Dec. 14, 1976 for a, "REMINDER DEVICE FOR MEDICINE AND THE LIKE", describes a device having an open ended collar that mounts on a cylindrical shaped container such as a vial. A display unit with windows is mounted on the collar. The display unit has a spring loaded and movable slide element to selectively cover a window and its associated notation. Because medication containers have various shapes and sizes, a wide variety of such devices would have to be manufactured. Both the collar and display unit, are molded and the display unit is very intricate, making the device costly to produce.

U.S. Pat. No. 6,032,609 granted to Van A. Luoma on Mar. 7, 2000 for a "DOSAGE INDICATOR MEDICINE CONTAINER" describes a system for permanently recording the taking of medication directly on a disk or strip. This record also serves to indicate if the medication was taken. The disk may be affixed to the top of a medication closure and the strip may be affixed to the wall surface of a medication container. A number of different possible ways to indicate the recording are described. All require appropriate indicia on the disk and strip and all require the patient to irreversibly mark a specific predetermined location on the disk and strip. Although not mentioned, the device could conceivably be affixed to a medication carton. In practice this device is not practical for use on small containers such as those commonly used for pharmaceutical packages. The device requires a discrete location relating to each dose and would quickly encounter a space issue for any dosage regimen that is not of very short duration. In addition, in order for the indicia to contain the required information, the printing could become very small and crowded. The inventor suggests stacking disks and strips one on another in cases where a single disk or strip may not be able to display all the dosage events for the medication in the container. This can become cumbersome and demands a certain degree of dexterity, which not all patients may have. Marking a disk or strip in an exact small area could be problematic and prone to irreversible errors. A significant number of patients who could most benefit from a reminder device, are in an age group that generally suffers from reduced vision and reduced dexterity, making correct use of the device difficult. Every self-monitored program is subject to human error and defeat. A permanent record does not necessarily offer any increased assurance of compliance over any other compliance aid. Furthermore, recording the taking of medication is not necessary in most cases. Given that this device relies on irreversible marking to record an event, customization by the Pharmacist or patient does not appear to be simple or practical.

U.S. Pat. No. 6,152,067 granted to Ronald Grant Mathison on Nov. 28, 2000 for a "MEDICATION DOSAGE REMINDER DEVICE" describes a device having a cruciform hub that attaches to a medication container and an annular dial. The dial is further pinned between the hub and the container by a portion of the hub, but is otherwise free to rotate about the hub. When the dial is rotated, a pointer on the hub and indicia on the dial co-operate to indicate a dosage time. Although not mentioned, the device could conceivably be affixed to a medication carton. The device requires a close fit between the hub and the dial aperture in order to operate properly. This would necessitate the use of highly flexible materials to permit assembly. The device then relies on material rigidity in order to pin and maintain the position of the dial. The requirement for such a delicate balance between competing properties imposes an extreme limit on the choice of suitable materials. In use, this reminder device is placed on a medication container by first securing the rear surface of the hub to the container by way of an adhesive strip that runs laterally from one end of the hub to the other. The longitudinal tabs are then deformed in order to slip both of them through the central aperture in the dial and then restored to substantially their original orientation. Given the small device size dictated by today's pharmaceutical packages, and given the necessary material properties, it would seem to require a fair degree of dexterity to mount the hub and then assemble the device on a flat carton surface. It would also seem to be difficult to make the longitudinal tabs, one of which acts as a pointer, lie in a plane that is parallel to the plane of the dial and the associated indicia. It appears as though it would further be difficult to take sufficient care to ensure that the pointer does not deflect or change planes in operation. In such a case accurate referencing of indicia on the dial could become difficult at best and dangerous at worst.

There is a definite need for improving what the medical profession calls "patient compliance", but it is evident that to date, the inventive art has not adequately met the challenge. The more complex of these devises and systems offer far more features and control than what the vast majority of patients require. Their costs are also prohibitive. With the advancing average age of patients and their increased reliance on multiple concomitant self-administered medicines, there is a growing unfulfilled need for a simple, acceptable mass-market compliance aid. A device that is most likely to gain broad acceptance is one that conserves the current well established medication delivery packaging and one that compliments rather than changes dispensing and consumption procedures.

While considerable inventor attention has been focused on the need for an acceptable reminder device for medication delivered to the user in a prescription vial, other equally important medication packaging formats have been largely overlooked. It would be beneficial to patients if a medication reminder device could be included with all formats and packaging. These can include bottles, jars, syringes, tubes, inhalers, and standard blister cards to name a few. There is also an increasing trend, driven in part by the need to attract consumer attention, for manufacturers to further package already contained prescription and over the counter (OTC) products in an outer container or folding carton. The patient throughout the course of treatment generally retains this outer medication container because it serves as a convenient holder for the contents or, the Pharmacist has affixed the prescription label to it, a practice that is common.

While many shapes of cartons are available, virtually all have an exterior wall surface that includes a somewhat flat portion. Conventionally, this carton has the shape of a rectangular parallelepiped and comprises a sleeve portion consisting of four walls, which are interconnected by folding lines. End flaps are connected to the sleeve portion along folding lines in order to close the ends of the carton. Normally, one end of the carton is permanently closed, the end flaps being for example glued to one another. The other end of the carton is closed by means of a tuckin tab, which is connected along a folding line to one of the end flaps. Consequently, the carton can easily he opened and reclosed at this end, such that the patient can remove a blister pack or other contents from the carton. User instructions are generally enclosed in the form of a separate leaflet, which is placed inside the carton.

This kind of tubular carton is made from an essentially rectangular sheet blank having a sleeve-forming portion with four wall-forming panels arranged side by side and being interconnected by folding lines. A closure tab is connected along a folding line to a first wall-forming panel on one side of the sleeve-forming portion. When the carton is erected, the closure tab is engaged, for example by means of adhesive, with a second wall-forming panel on the other side of the sleeve-forming portion. The blank further comprises end flaps, which are connected along folding lines to both ends of the sleeve-forming portion.

These medication cartons are mass-produced in a wide variety of wall thickness and sizes that are customized to suit the individual medication being packaged. It would be beneficial to patients and advantageous to manufacturers to have a simple reminder device that could be associated with all standard medication cartons or to have a simple construction modification of all medication cartons that could be incorporated into the production process to accomplish the same end. A reminder device on the outside of the carton would even be useful in cases where immediate packaging has some form of reminder because it would obviate the need for the user to open the carton in order to make a determination.

A device, which could be attached to a somewhat flat portion of the exterior surface of the carton, could equally be attached to any container or article having a somewhat flat portion in its exterior surface. This could include a blister card package, a bottle, a lid etc. A simple construction modification could also possibly be incorporated into the production process of other containers or articles having a somewhat flat portion in their exterior surface to accomplish the same end.

SUMMARY

The invention is a dosage reminder device and medication carton to which the reminder device is attached. All parts or members are manufactured from sheet stock such as paper, cardboard, metal or plastic. Included in the device are a sheet support member and a movable member which are retentively engaged with each other, the engagement being facilitated by permanent deformation of one of the members. The support member influences movement of the retained member, but the movable member may be displaced to a plurality of positions. Attachment of the device is accomplished by integrally producing the support member in the carton sheet blank at a predetermined final position in the erected carton and assembled in place with the movable member. Alternatively a sheet support member including pressure sensitive adhesive on the back is assembled with the movable member and attached to the carton surface. One of the members in the device has dosage time period indicia that may be inscribed by a Pharmacist or user to establish a dosage schedule, in accordance with prescribed instructions. Another member in the device has a co-operating indicator pointer. The indicator pointer and the scheduled dosage time period indicia form a reminder indicating when the next dose is due or when the last dose was taken.

OBJECTS AND ADVANTAGES

Accordingly, besides the objects and advantages of the dosage reminder device and medication carton described in my above patent, several objects and advantages of the present invention are;

a) to provide a device that is suitable for most patients and one that can be included with most common medication carton containers;

b) to provide a device that is suitable for most patients and one that can be attached to the exterior wall surface of most standard pre-existing medication containers or articles which include a somewhat flat exterior wall surface;

c) to provide a device that minimizes the potential for error, through ease of use, legibility and logical positional placement on the medication container;

d) to provide a device that achieves these goals at a very low cost.

Further objects and advantages of my invention will become apparent from consideration of the drawings and ensuing description.

DRAWING FIGURES

FIG. 1 is a perspective view of a preferred embodiment of my invention. In this example, the dosage reminder device is part of a typical medication carton bearing a traditional pharmacy prescription label. It shows a ring rotating about an indicator pointer. The pharmacy prescription label depicted is not part of the invention.

Figure 27:
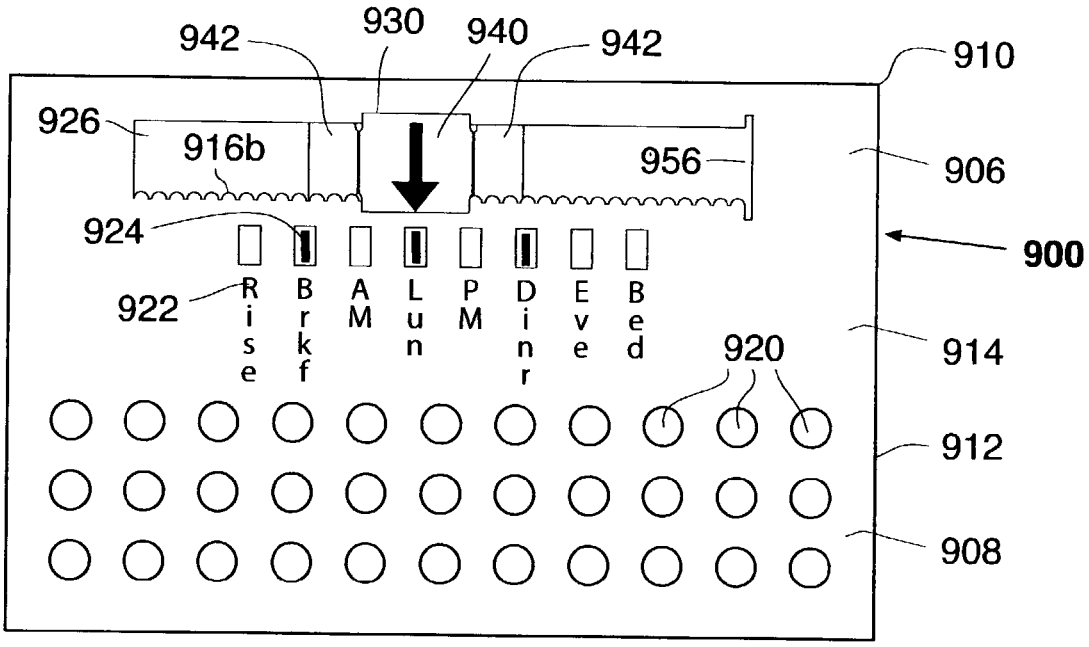

FIG. 27 is a front view of an additional alternative ninth embodiment of my invention. In this example, the dosage reminder device is part of a medication blister card package. It shows a sliding indicator pointer held in the wall of the blister card.

Figure 28:
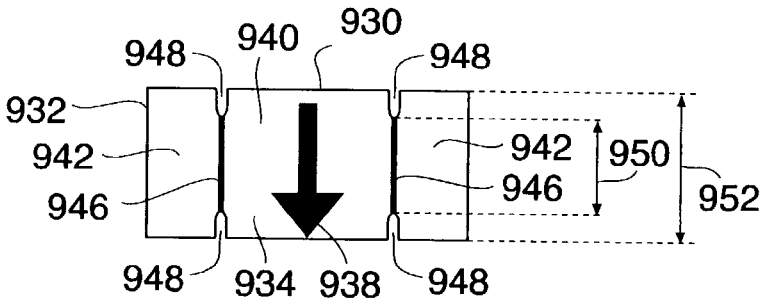

FIG. 28 is an enlarged front view of the indicator of FIG. 27 prior to assembly with the blister card.

Figure 29:
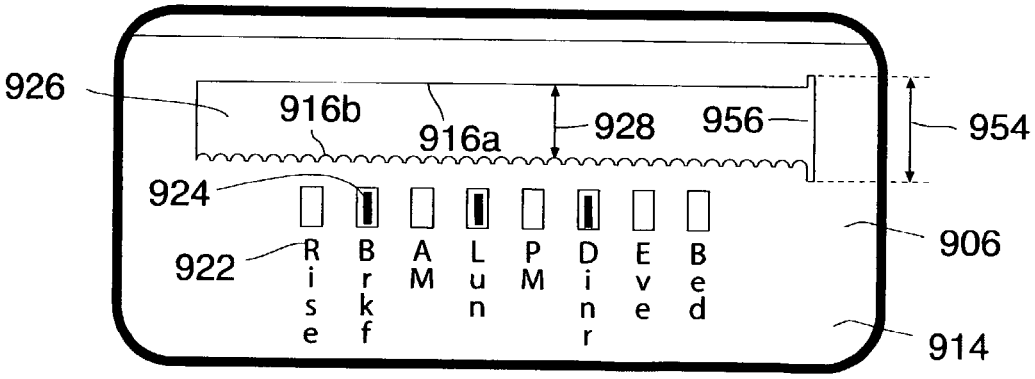

FIG. 29 is a partial front view of the blister card of FIG. 27 showing the flat portion prior to assembly with the indicator pointer.

Figure 30:
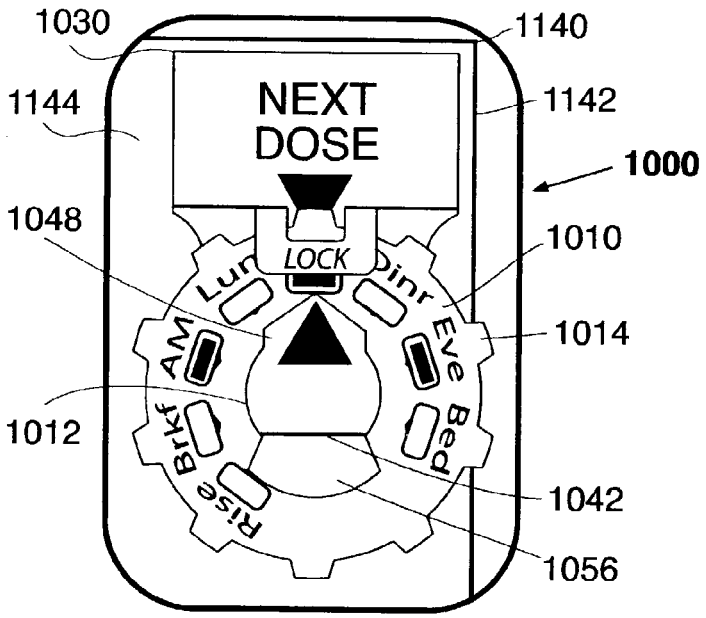

FIG. 30 is a partial front view of an additional tenth embodiment of my invention. In this example the device is adhesively attached to the wall surface of a standard pre-existing medication carton.

Figure 31:
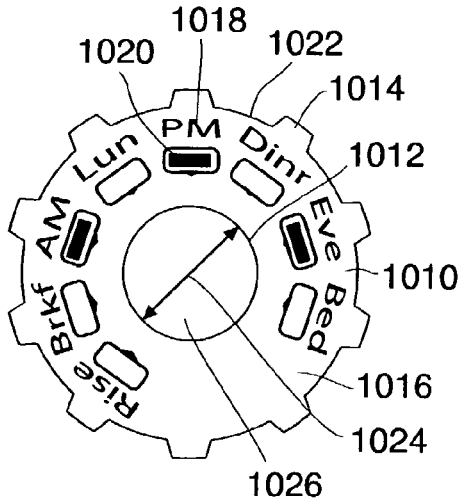

FIG. 31 is a front view of the movable ring member of FIG. 30.

Figure 32:
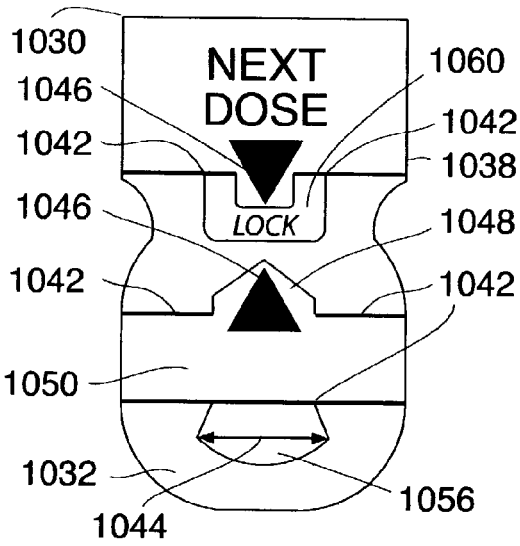

FIG. 32 is a front view of the support member of FIG. 30, showing the indicator, retention flap, lock and creases.

Figure 33:
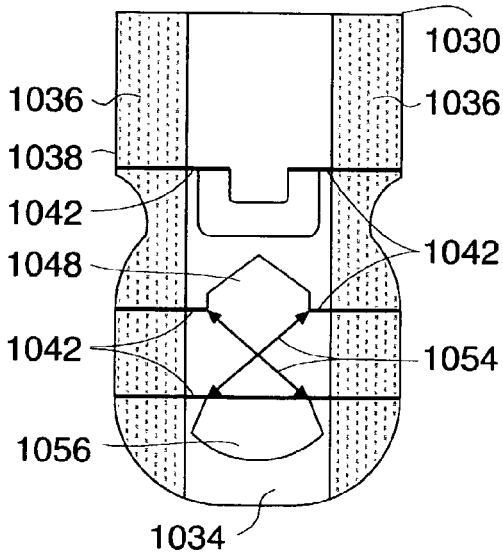

FIG. 33 is a back view of the support member of FIG. 30, showing the pressure sensitive adhesive.

Figure 34:
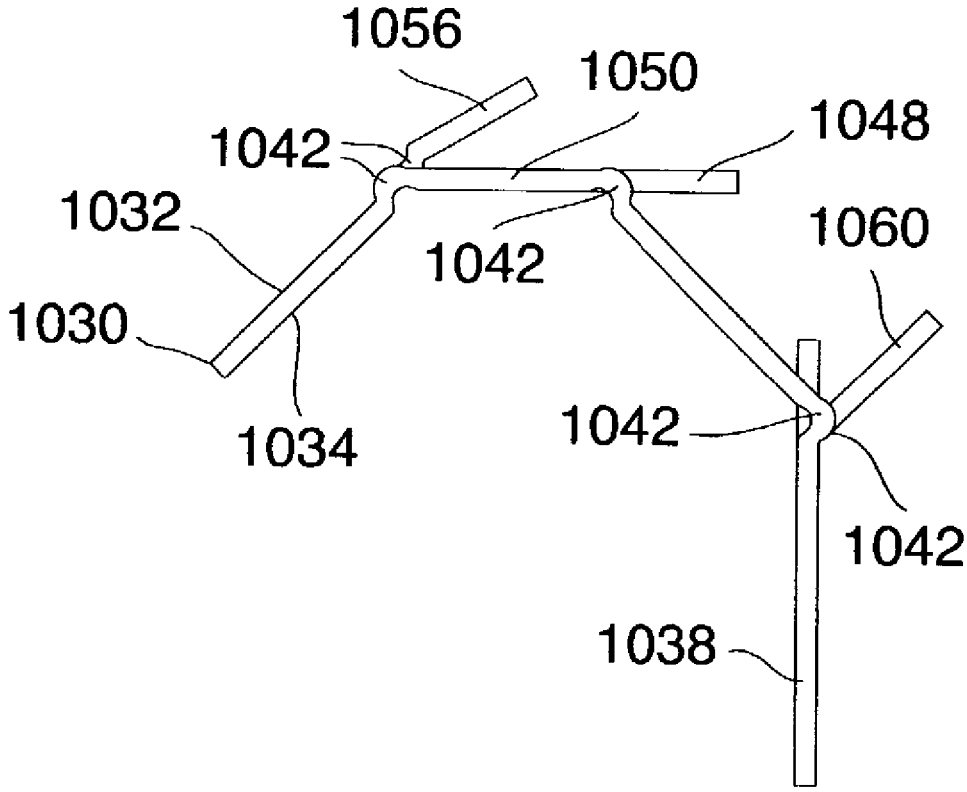

FIG. 34 is an enlarged side view of the support of FIG. 30, showing the wall of the support bent at creases to facilitate assembly with the ring member.

Reference Numerals in Drawings

Figure 1:
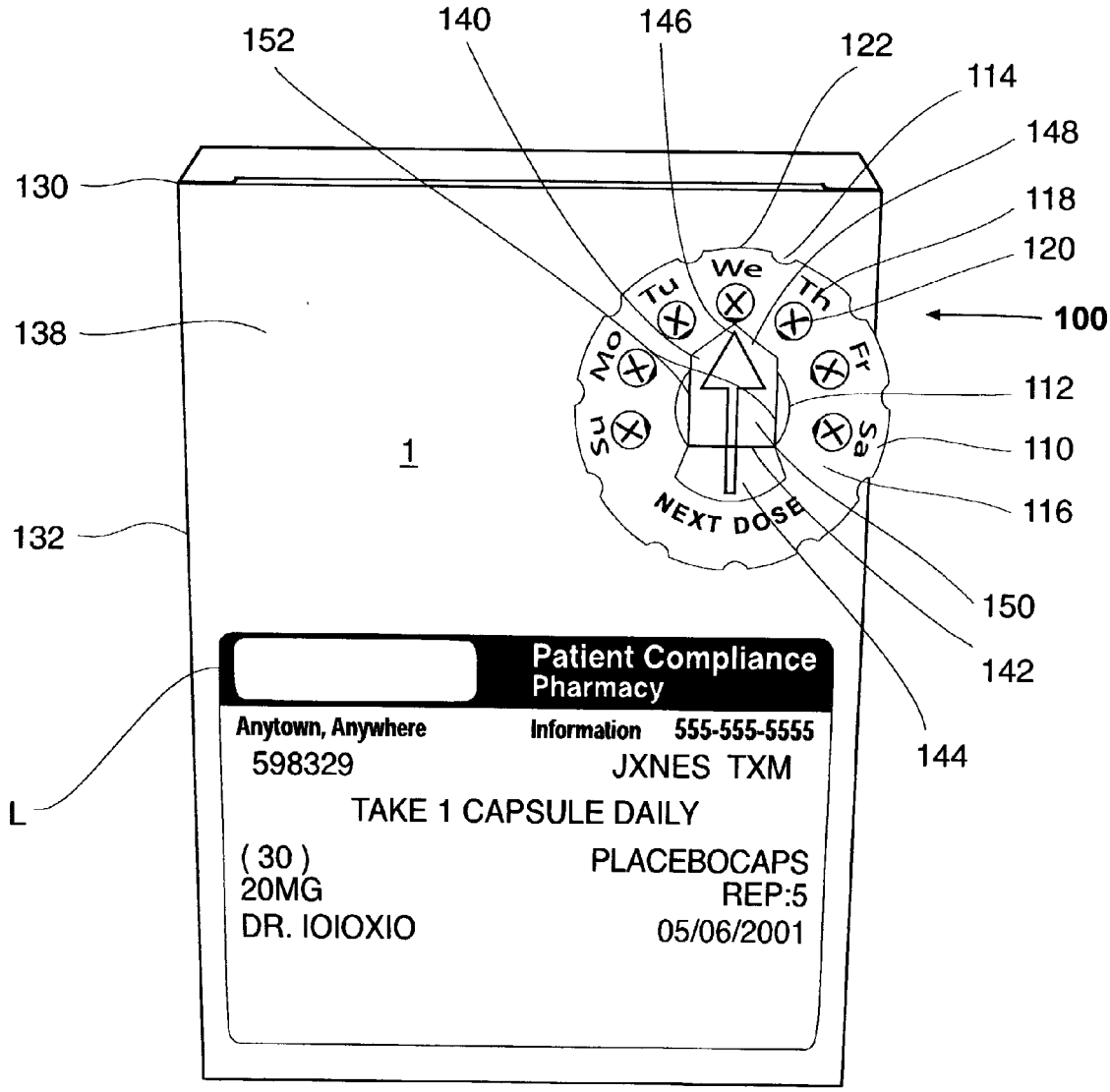
FIG. 1A is a reduced plan view of the carton sheet blank used to erect the carton of FIG. 1.
FIG. 1B is an exploded perspective view showing a carton erected from the carton blank in FIG. 1A before closing and a proportionately sized ring like that in FIG. 1 before mounting.
FIG. 1C is an exploded reduced perspective view showing an erected carton before closing and an indicator before mounting like those in FIG. 16.
Figure 3:
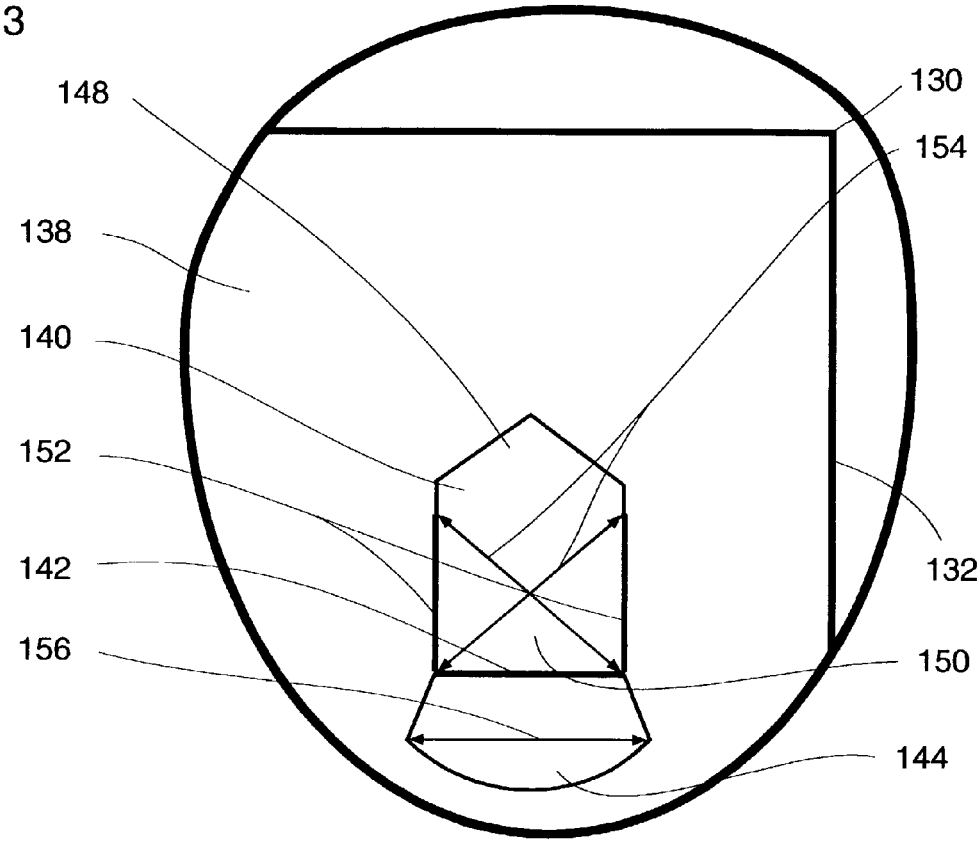
FIG. 3 is an enlarged partial front view of the carton of FIG. 1, showing the indicator/support.
Figure 4:
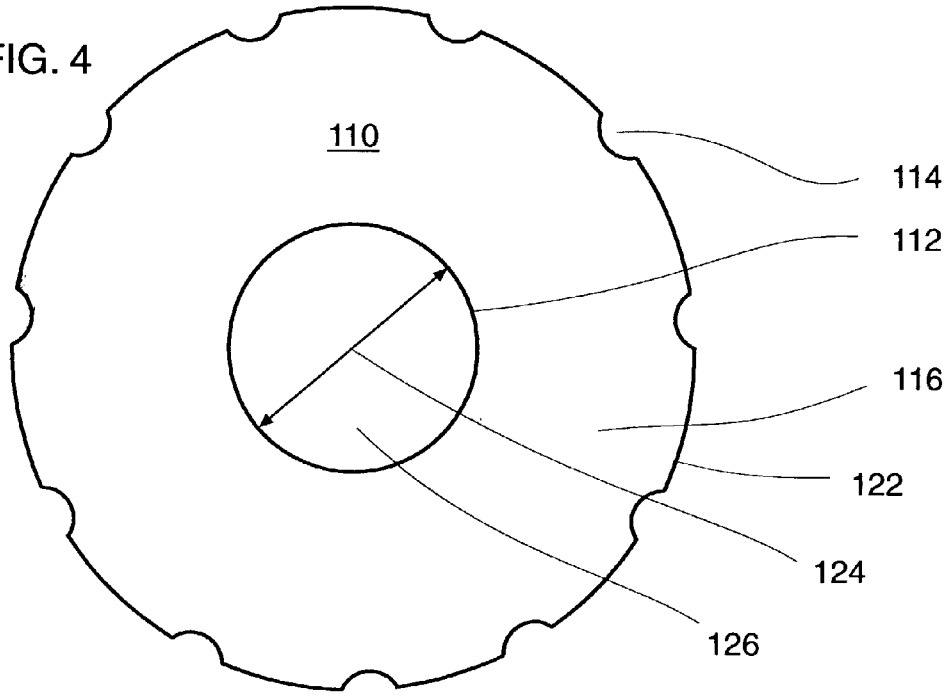
FIG. 4 is an enlarged front view of the ring of FIG. 1.

| | | |
|---|---|---|
| L | Prescription Label | (FIG. 1) |
| 1 | Front Wall Panel | (FIGS. 1, 1A, 1B) |
| 1m | Front Wall Panel | (FIG. 1C) |
| 2 | First Sidewall Panel | (FIGS. 1A, 1B) |
| 3 | First Folding Line | (FIG. 1A) |
| 4 | Back Wall Panel | (FIG. 1A) |
| 5 | Second Folding Line | (FIG. 1A) |
| 6 | Second Sidewall Panel | (FIG. 1A) |
| 7 | Third Folding Line | (FIG. 1A) |
| 8 | Closure Tab | (FIGS. 1A, 1B) |
| 9 | Fourth Folding Line | (FIG. 1A) |
| 10 | End Flap | (FIG. 1A) |
| 11 | End Flap | (FIGS. 1A, 1B) |
| 12 | End Flap | (FIG. 1A) |
| 13 | End Flap | (FIGS. 1A, 1B) |
| 14 | End Flap | (FIG. 1A) |
| 15 | End Flap | (FIGS. 1A, 1B) |
| 16 | Folding Line | (FIG. 1A) |
| 17 | Folding Line | (FIG. 1A) |
| 18 | Folding Line | (FIG. 1A) |
| 19 | Folding Line | (FIG. 1A) |
| 20 | Folding Line | (FIG. 1A) |
| 21 | Folding Line | (FIG. 1A) |
| 22 | Tuck-in Tab | (FIGS. 1A, 1B) |
| 23 | Folding Line | (FIG. 1A) |
| 26 | Sidewall Panel Edge | (FIG. 1A) |
| 32 | End Flap | (FIG. 1A) |
| 33 | Folding Line | (FIGS. 1A, 1B) |
| 100 | Reminder Device | (FIGS. 1, 2, 5D) |
| 108 | Ring Wall | (FIG. 5A, 5C, 5D, 10B, 10C) |
| 110 | Ring | (FIGS. 1, 1B, 2, 4, 5A, 5C, 5D, 6, 8, 10B, 10C, 15) |
| 112 | Aperture Perimeter | (FIGS. 1, 2, 4, 5A, 5C, 5D, 8, 10B, 10C) |
| 114 | Outer Perimeter Notch | (FIGS. 1, 2, 4) |
| 116 | Ring Front Surface | (FIGS. 1, 2, 4, 5A, 5C, 5D) |
| 118 | Scheduling Indicia | (FIGS. 1, 2, 15) |
| 120 | Schedule Mark | (FIGS. 1, 2, 15) |
| 122 | Ring Outer Perimeter | (FIGS. 1, 2, 4) |
| 124 | Aperture Diameter | (FIG. 4) |
| 126 | Ring Aperture | (FIG. 4) |
| 130 | Medication Carton | (FIGS. 1, 2, 3, 5B) |
| 132 | Carton Front Wall | (FIGS. 1, 1C, 2, 3, 5B, 5C, 5D) |
| 134 | Carton Back Wall | (FIGS. 5B, 5C, 5D) |
| 136 | Carton Interior | (FIGS. 5B, 5C, 5D) |
| 138 | Front Wall Surface | (FIGS. 5B, 5C, 5D, 1, 2, 3) |
| 140 | Indicator/Support | (FIGS. 1, 1A, 1B, 2, 3, 5B, 5C, 5D) |
| 141 | Indicator/Support | (FIGS. 6, 7A, 7B) |
| 142 | Crease Hinge | (FIGS. 1, 2, 3, 5B, 5C, 5D) |
| 144 | Indicator Tail | (FIG. 1, 2, 3, 5B, 5C, 5D) |
| 146 | Next Dose Pointer | (FIGS. 1, 2) |
| 148 | Indicator Head | (FIGS. 1, 2, 3, 5B, 5C, 5D) |
| 150 | Indicator Body | (FIGS. 1, 2, 3, 5B, 5C, 5D) |
| 152 | Side Connecting Wall | (FIGS. 1, 2, 3, 5B, 5C, 5D) |
| 154 | Walls Maximum Distance | (FIG. 3) |
| 156 | Tail Width | (FIG. 3, 15) |
| 160 | Head Space | (FIG. 5B) |
| 162 | Tail Space | (FIG. 5B) |
| 200 | Reminder Device | (FIG. 6) |
| 230 | Rectilinear Support Member | (FIGS. 7A, 7B) |
| 232 | Rectilinear Member Front Surface | (FIGS. 6, 7A) |
| 234 | Rectilinear Member Back Surface | (FIG. 7B) |
| 236 | Pressure Sensitive Adhesive | (FIG. 7B) |
| 238 | Rounded Corner | (FIGS. 7A, 7B) |
| 240 | Standard Medication Carton | (FIG. 6) |

-continued

Reference Numerals in Drawings

Figure 9:
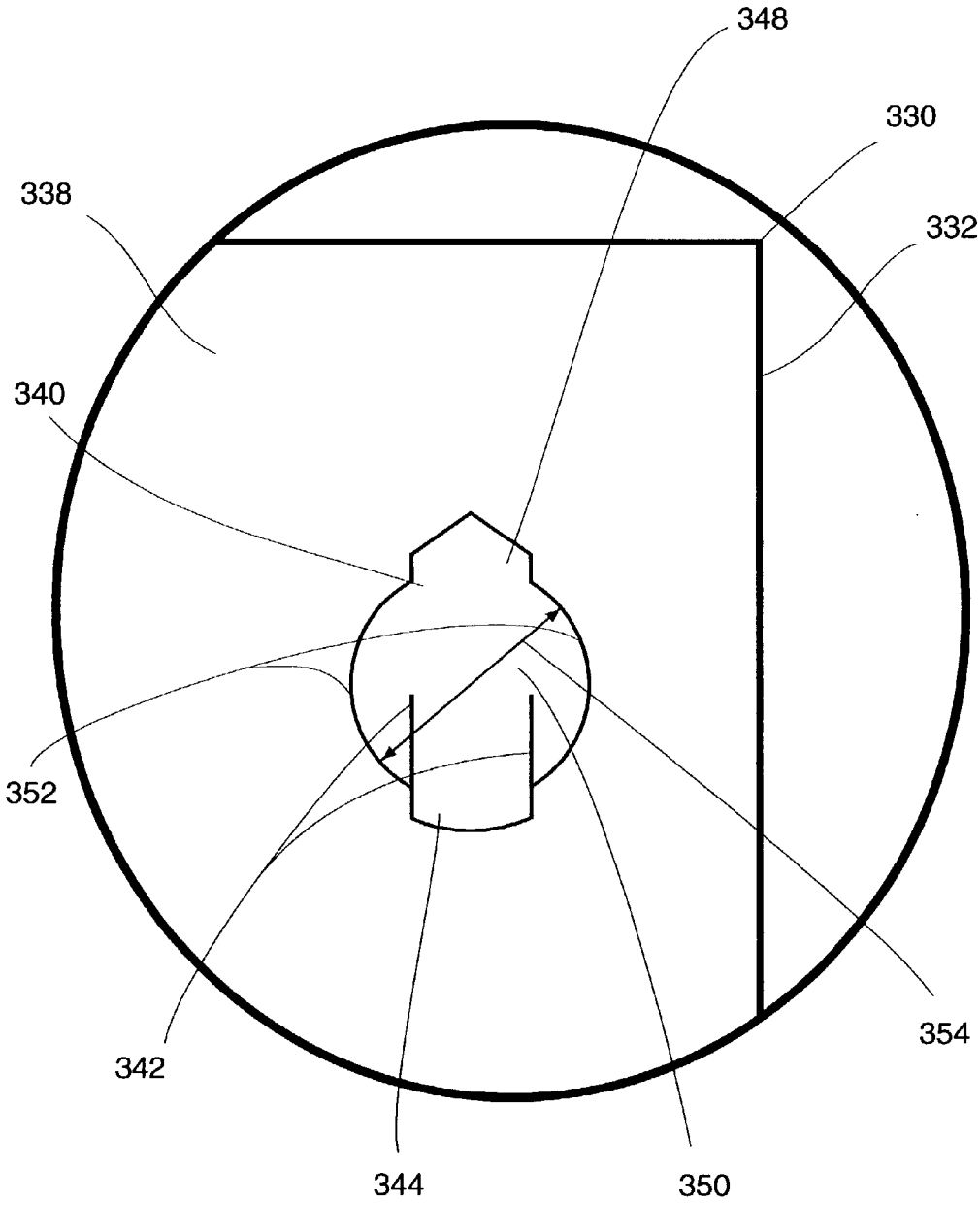
FIG. 9 is a partial front view of the carton of FIG. 8, showing the indicator/support.
Figure 10A:
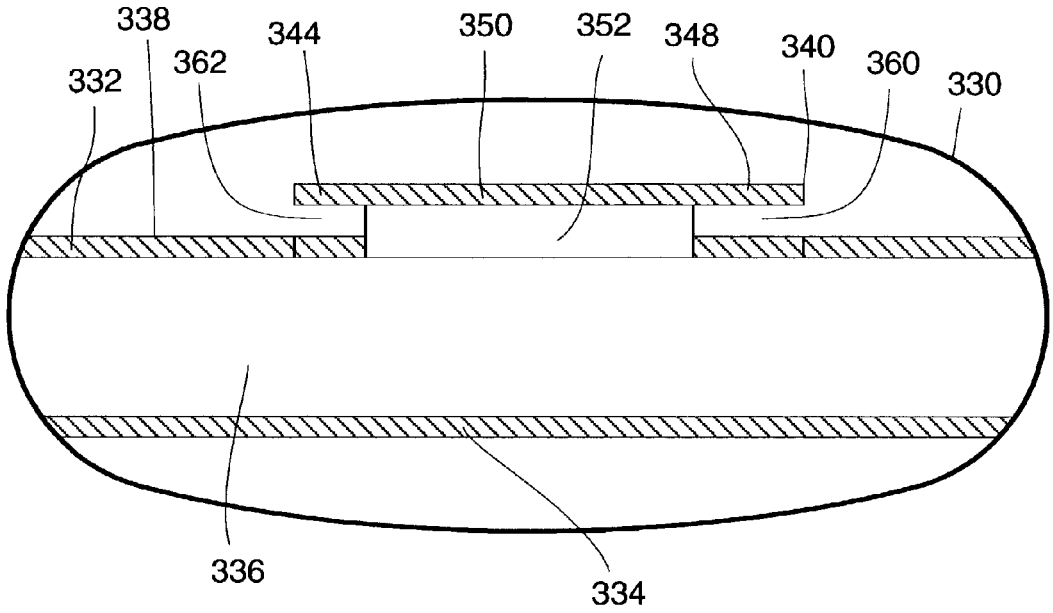
FIG. 10A is an enlarged partial side cross-sectional view of the carton of FIG. 8, showing the indicator/support.
Figure 10B:
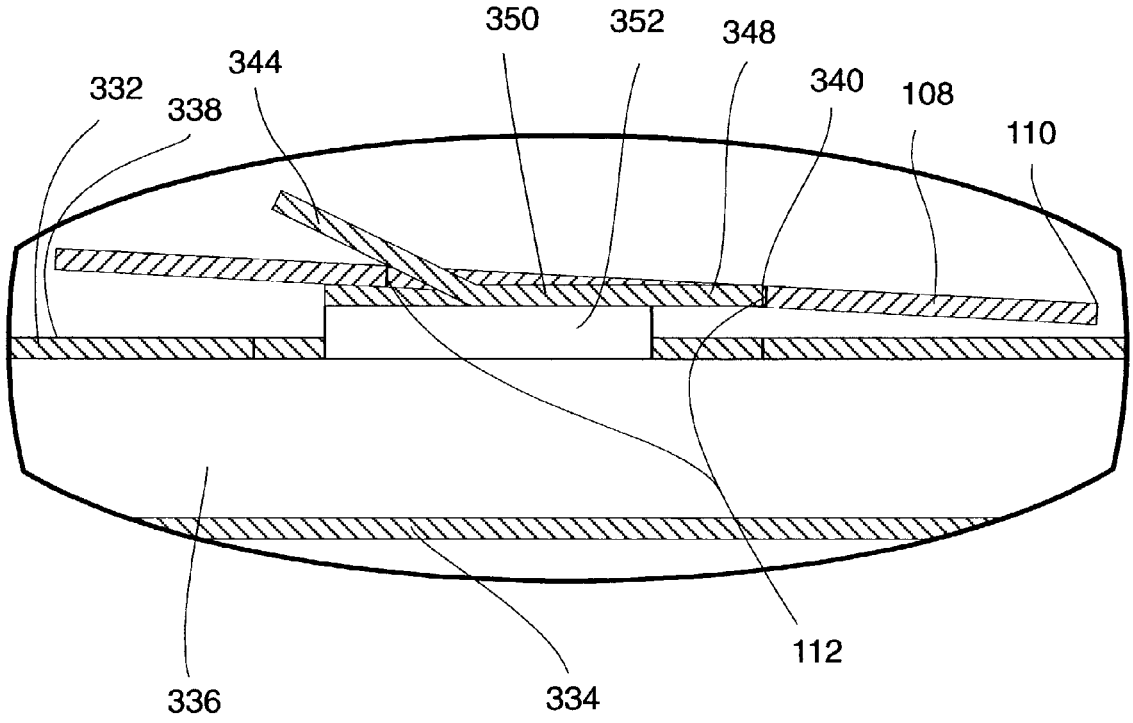
FIG. 10B is an enlarged partial side cross-sectional view showing the device of FIG. 8 being assembled.
Figure 10C:
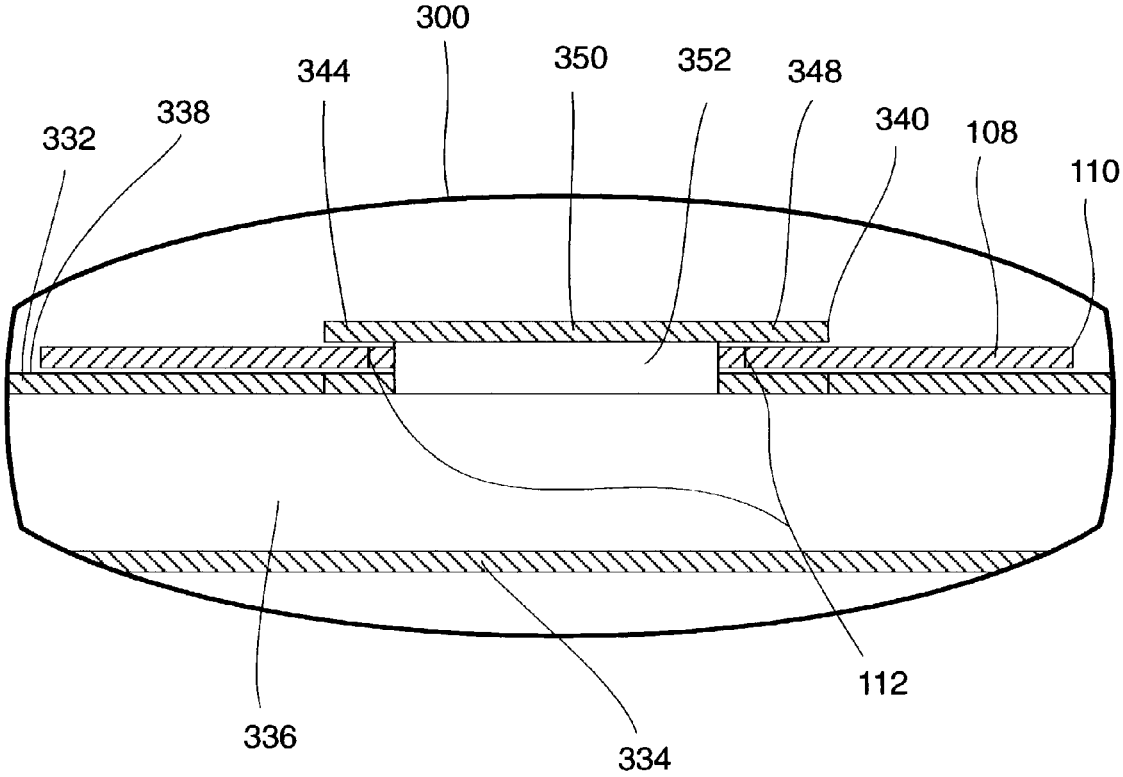
FIG. 10C is an enlarged partial side cross-sectional view of the device of FIG. 8.
Figure 12:
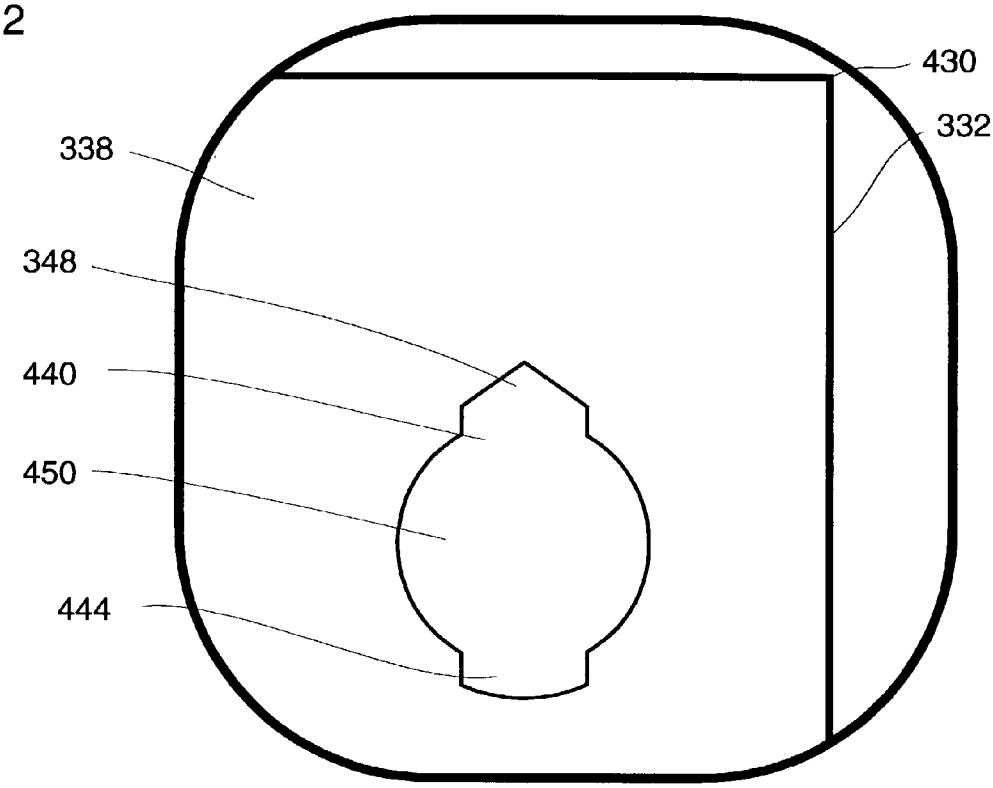
FIG. 12 is a partial front view of the carton of FIG. 11, showing the indicator/support.
Figure 13:
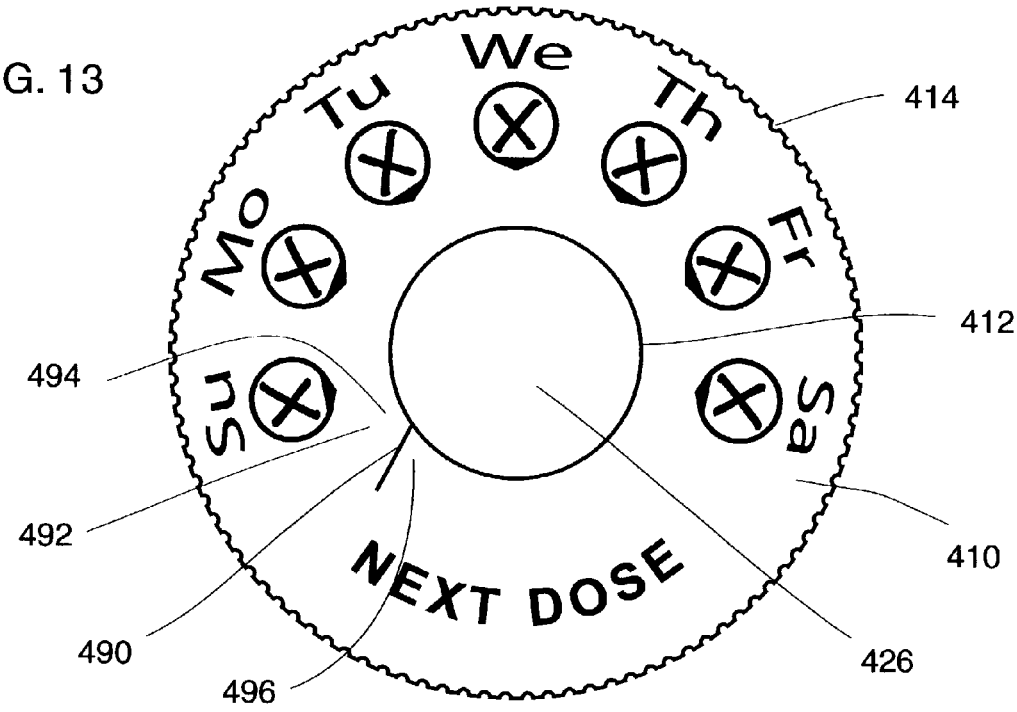
FIG. 13 is a front view of the partially split ring of FIG. 11.
Figure 21:
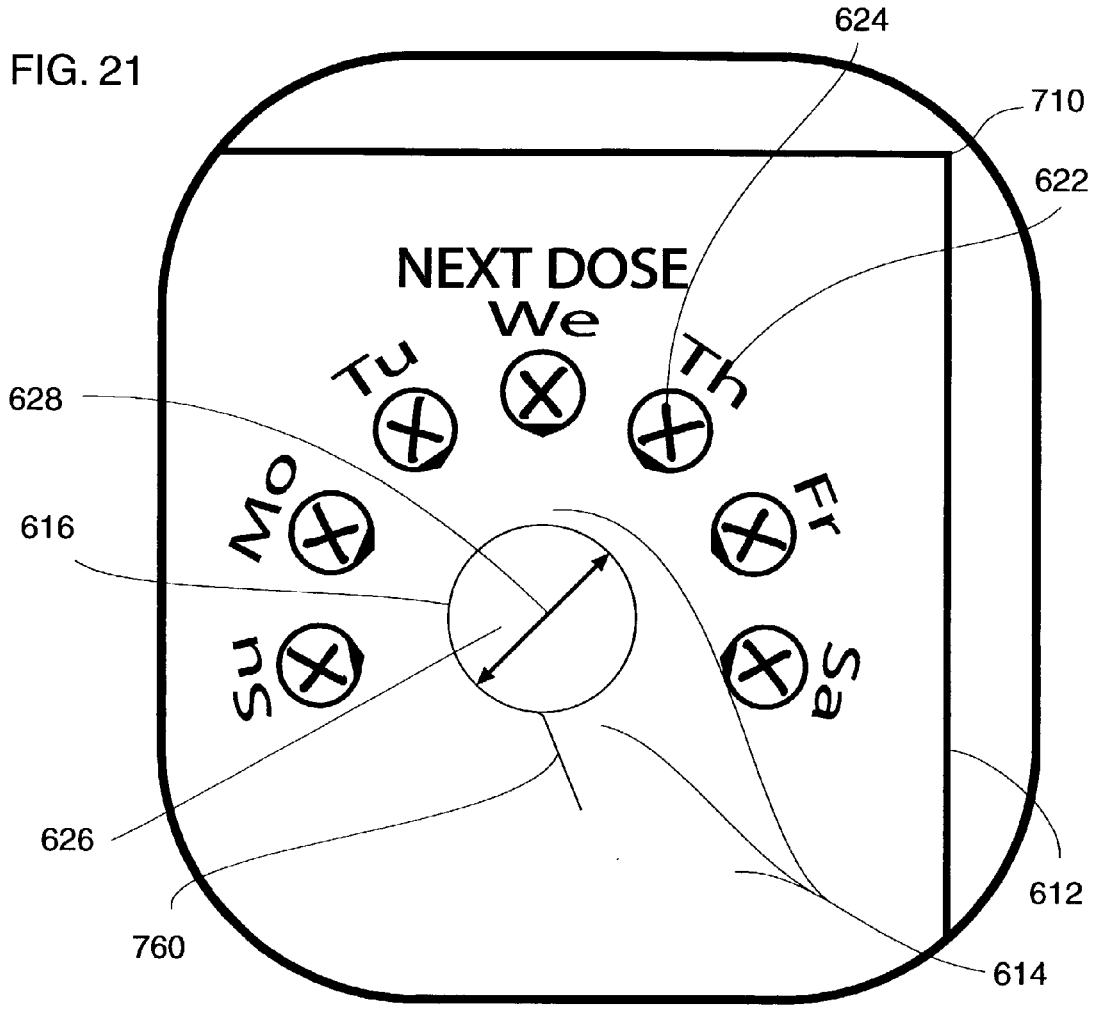
FIG. 21 is a partial front view of the carton of FIG. 20 showing the partially split aperture.
Figure 22:
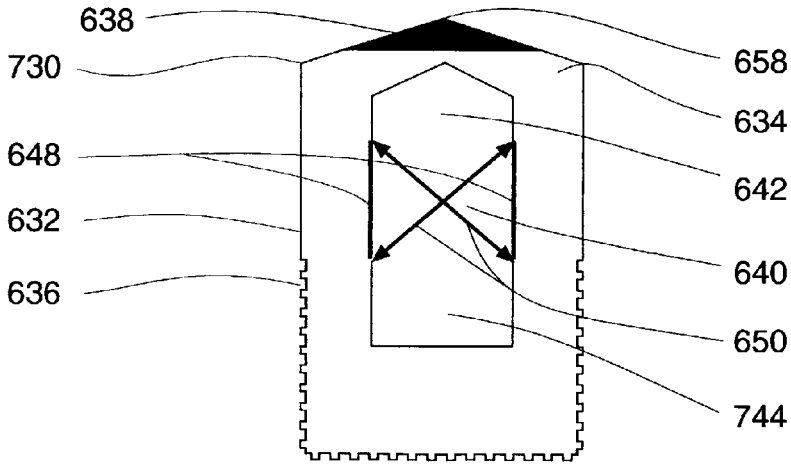
FIG. 22 is a front view of the indicator of FIG. 20.
Figure 23:
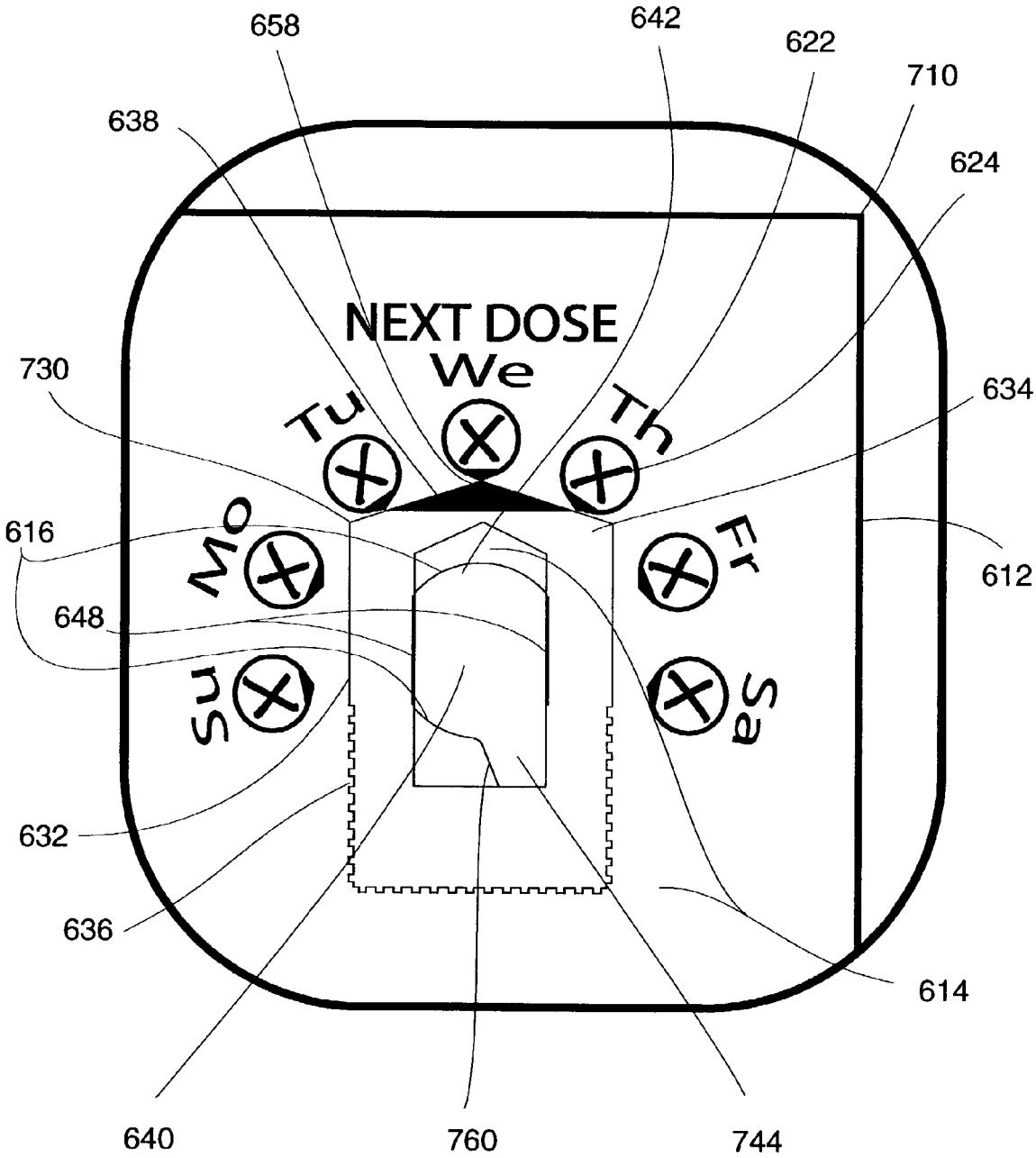
FIG. 23 is a partial front view showing the device of FIG. 20 being assembled.
Figure 24:
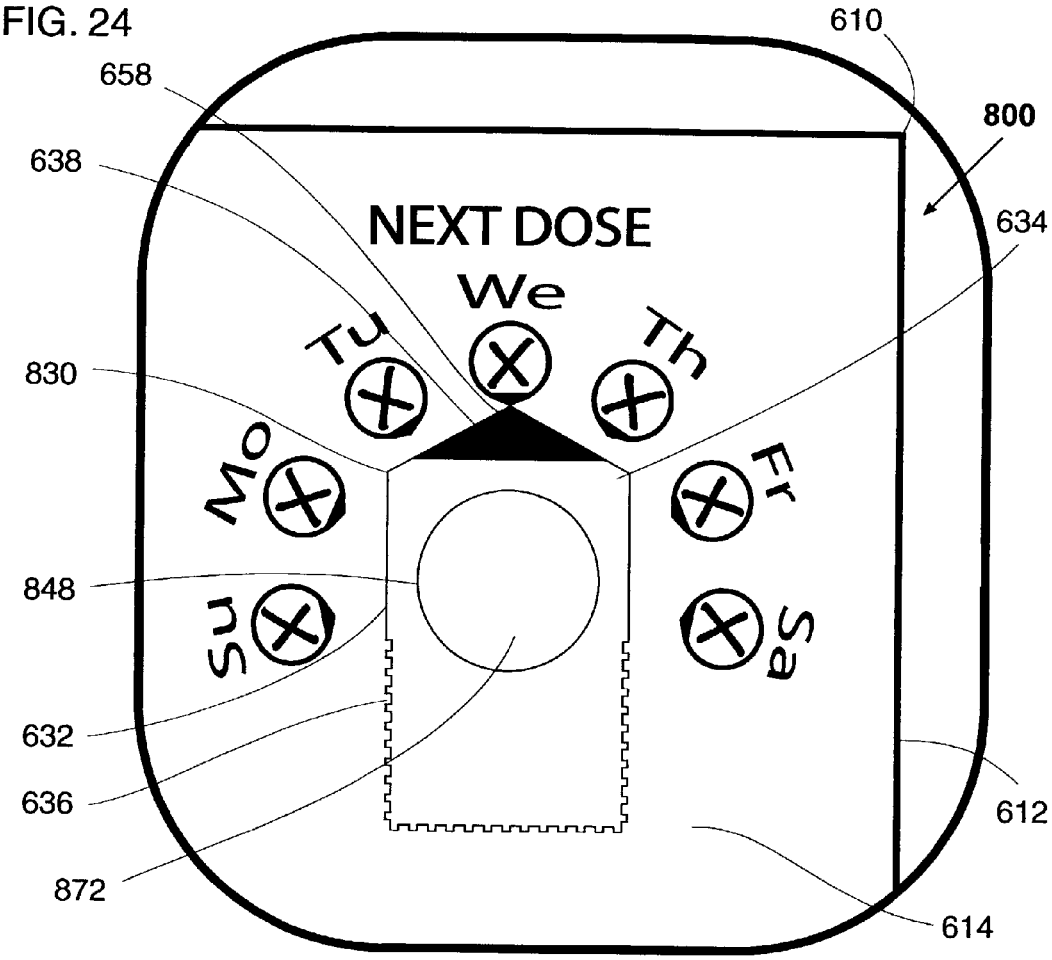
FIG. 24 is a partial front view of an additional alternative eighth embodiment of my invention.
Figure 25:
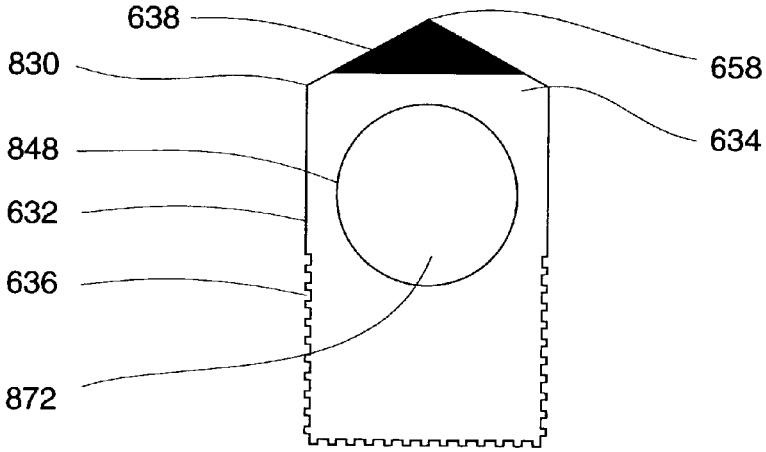
FIG. 25 is a front view of the blister indicator of FIG. 24.
Figure 26A:
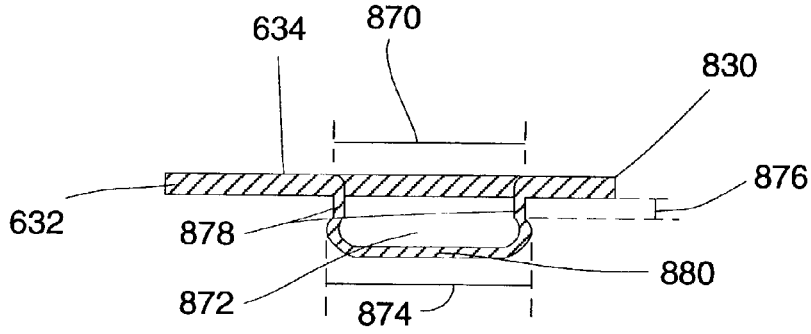
FIG. 26A is an enlarged side cross-sectional view of the blister indicator of FIG. 24.
Figure 26B:
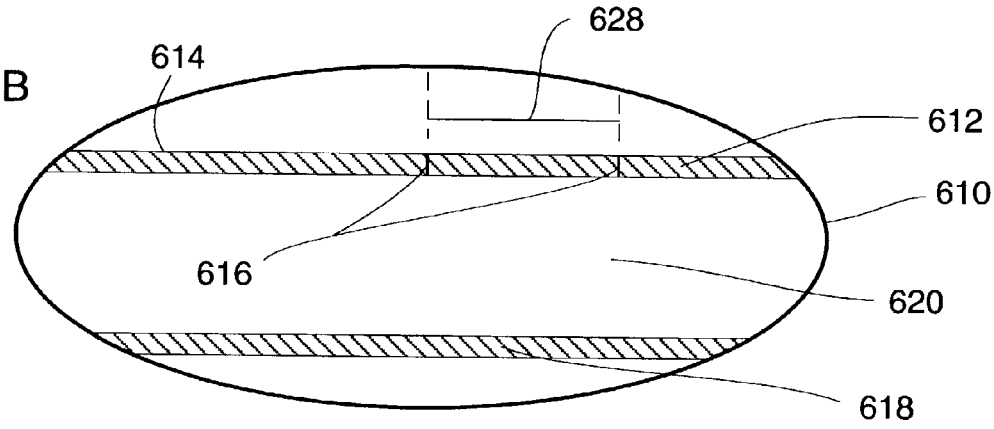
FIG. 26B is an enlarged partial side cross-sectional view of the carton of FIG. 24, showing the aperture perimeter.
Figure 26C:
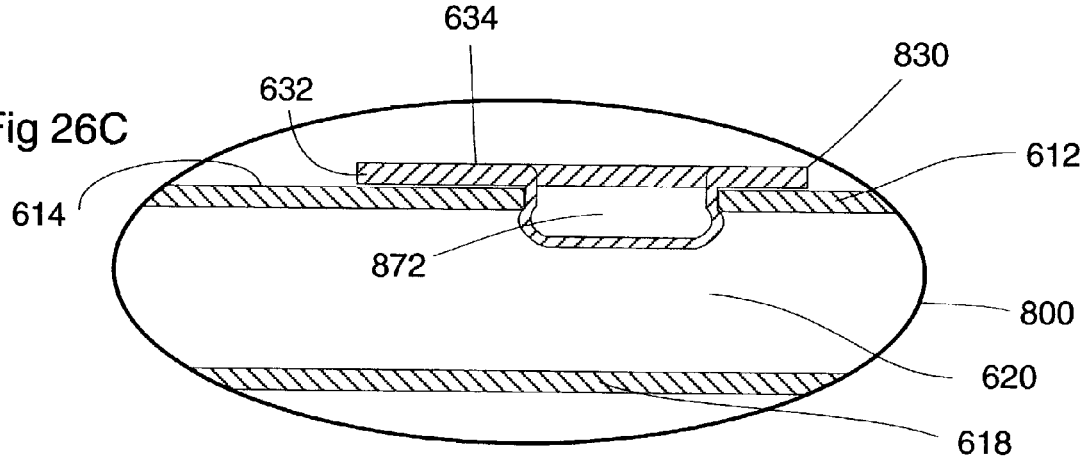
FIG. 26C is an enlarged partial side cross-sectional view of the device of FIG. 24.

| | | |
|---|---|---|
| 242 | Carton Front Wall | (FIG. 6) |
| 244 | Front Wall Surface | (FIG. 6) |
| 246 | Pointer | (FIG. 6) |
| 300 | Reminder Device | (FIGS. 8, 10C) |
| 330 | Medication Carton | (FIGS. 8, 9, 10A) |
| 332 | Carton Front Wall | (FIGS. 8, 9, 10A, 10B, 10C, 11, 12, 14, 15) |
| 334 | Carton Back Wall | (FIGS. 10A, 10B, 10C) |
| 336 | Carton Interior | (FIGS. 8, 10A, 10B, 10C) |
| 338 | Front Wall Surface | (FIGS. 8, 9, 10A, 10B, 10C, 11, 12, 14, 15) |
| 340 | Indicator/Support | (FIGS. 8, 9, 10A, 10B, 10C) |
| 342 | Indicator Scores | (FIGS. 8, 9) |
| 344 | Indicator Tail | (FIGS. 8, 9, 10A, 10B, 10C) |
| 346 | Next Dose Pointer | (FIG. 8, 11, 14) |
| 348 | Indicator Head | (FIGS. 8, 9, 10A, 10B, 10C, 11, 12, 14) |
| 350 | Indicator Body | (FIGS. 8, 9, 10A, 10B, 10C) |
| 352 | Side Connecting Walls | (FIGS. 8, 9, 10A, 10B, 10C) |
| 354 | Side Connecting Walls Diameter | (FIG. 9) |
| 360 | Head Space | (FIG. 10A) |
| 362 | Tail Space | (FIG. 10A) |
| 400 | Reminder Device | (FIG. 11) |
| 410 | Serrated Ring | (FIG. 11, 13, 14) |
| 412 | Aperture Perimeter | (FIG. 13) |
| 414 | Serrated Outer Perimeter | (FIG. 11, 13, 14) |
| 426 | Ring Aperture | (FIG. 13) |
| 430 | Medication Carton | (FIG. 11, 12, 14) |
| 440 | Indicator/Support | (FIG. 11, 12, 14) |
| 444 | Indicator Tail | (FIG. 11, 12, 14) |
| 450 | Indicator Body | (FIG. 11, 12, 14) |
| 490 | Partial Ring Split | (FIG. 11, 13, 14) |
| 492 | Pressure Point | (FIG. 11, 13) |
| 494 | Left Side of Split | (FIG. 11, 13, 14) |
| 496 | Right Side of Split | (FIG. 11, 13, 14) |
| 500 | Reminder Device | (FIG. 15) |
| 530 | Medication Carton | (FIG. 15) |
| 542 | Crease Hinge | (FIG. 15) |
| 544 | Support | (FIG. 15) |
| 546 | Next Dose Pointer | (FIG. 15) |
| 554 | Hinges Maximum Distance | (FIG. 15) |
| 600 | Reminder Device | (FIGS. 16, 19D) |
| 610 | Medication Carton | (FIGS. 16, 17, 19B, 24, 26B) |
| 612 | Carton Front Wall | (FIGS. 1C, 16, 17, 19B, 19C, 19D, 20, 21, 23, 26B, 26C) |
| 614 | Carton Surface | (FIGS. 16, 17, 19B, 19C, 19D, 20, 21, 23, 24, 26B, 26C) |
| 616 | Aperture Perimeter | (FIGS. 16, 17, 19B, 19C, 19D, 20, 21, 23, 26B) |
| 618 | Carton Back Wall | (FIGS. 19B, 19C, 19D, 26B, 26C) |
| 620 | Carton Interior | (FIGS. 19B, 19C, 19D, 26B, 26C) |
| 622 | Scheduling Indicia | (FIGS. 16, 17, 20, 21, 23) |
| 624 | Schedule Mark | (FIGS. 16, 17, 20, 21, 23) |
| 626 | Carton Aperture | (FIGS. 1C, 17, 21) |
| 628 | Aperture Diameter | (FIGS. 17, 21, 26B) |
| 630 | Indicator | (FIGS. 1C, 16, 18, 19A, 19C, 19D) |
| 632 | Indicator Wall | (FIGS. 16, 18, 19A, 19C, 19D, 20, 22, 23, 24, 25, 26A, 26C) |
| 634 | Indicator Wall Surface | (FIGS. 16, 18, 19A, 19C, 19D, 20, 22, 23, 24, 25, 26A, 26C) |
| 636 | Serrated Outer Perimeter | (FIGS. 16, 18, 20, 22, 23, 24, 25) |

-continued

| Reference Numerals in Drawings | | |
|---|---|---|
| 638 | Next Dose Pointer | (FIGS. 16, 18, 20, 22, 23, 24, 25) |
| 640 | Mounting Body | (FIGS. 16, 18, 19A, 19C, 19D, 20, 22, 23) |
| 642 | Mounting Head | (FIGS. 16, 18, 19A, 19C, 19D, 20, 22, 23) |
| 644 | Mounting Tail | (FIGS. 16, 18, 19A, 19C, 19D) |
| 646 | Mounting Hinge | (FIGS. 16, 18, 19A, 19C, 19D) |
| 648 | Side Connecting Walls | (FIGS. 16, 18, 19A, 19C, 19D, 20, 22, 23) |
| 650 | Walls Maximum Distance | (FIGS. 18, 22) |
| 652 | Tail Width | (FIG. 18) |
| 654 | Indicator Head Space | (FIG. 19A) |
| 656 | Indicator Tail Space | (FIG. 19A) |
| 658 | Pointed Upper End | (FIGS. 16, 18, 20, 22, 23, 24, 25) |
| 700 | Reminder Device | (FIG. 20) |
| 710 | Medication Carton | (FIGS. 20, 21, 23) |
| 730 | Indicator | (FIGS. 20, 22, 23) |
| 744 | Mounting Tail | (FIGS. 20, 22, 23) |
| 760 | Carton Partial Split | (FIGS. 20, 21, 23) |
| 800 | Reminder Device | (FIGS. 24, 26C) |
| 830 | Indicator | (FIGS. 24, 25, 26A, 26C) |
| 848 | Blister Perimeter | (FIGS. 24, 25) |
| 870 | Blister First Outside Diameter | (FIG. 26A) |
| 872 | Blister | (FIGS. 24, 25, 26A, 26C) |
| 874 | Blister Second Outside Diameter | (FIG. 26A) |
| 876 | First Diameter Wall Length | (FIG. 26A) |
| 878 | Blister Side Wall | (FIG. 26A) |
| 880 | Blister Bottom | (FIG. 26A) |
| 900 | Reminder Device | (FIG. 27) |
| 906 | Flat Portion | (FIGS. 27, 29) |
| 908 | Blister Portion | (FIG. 27) |
| 910 | Medication Blister Package | (FIG. 27) |
| 912 | Blister Package Wall | (FIG. 27) |
| 914 | Package Front Surface | (FIGS. 27, 29) |
| 916a | Aperture Perimeter | (FIG. 29) |
| 916b | Serrated Aperture Perimeter | (FIGS. 27, 29) |
| 920 | Blister Cavities | (FIG. 27) |
| 922 | Scheduling Indicia | (FIGS. 27, 29) |
| 924 | Schedule Mark | (FIGS. 27, 29) |
| 926 | Card Aperture | (FIGS. 27, 29) |
| 928 | Aperture Height | (FIG. 29) |
| 930 | Indicator | (FIGS. 27, 28) |
| 932 | Indicator Wall | (FIG. 28) |
| 934 | Indicator Front Surface | (FIG. 28) |
| 938 | Next Dose Pointer | (FIG. 28) |
| 940 | Center Portion | (FIG. 27, 28) |
| 942 | Side Retention Flap | (FIGS. 27, 28) |
| 946 | Creased Hinge | (FIG. 28) |
| 948 | Notch | (FIG. 28) |
| 950 | Hinge Height | (FIG. 28) |
| 952 | Indicator Height | (FIG. 28) |
| 954 | Second Aperture Height | (FIG. 29) |
| 956 | Second Aperture | (FIGS. 27, 28) |
| 1000 | Reminder Device | (FIG. 30) |
| 1010 | Movable Member | (FIGS. 30, 31) |
| 1012 | Aperture Perimeter | (FIGS. 30, 31) |
| 1014 | Outer Perimeter Extension | (FIGS. 30, 31) |
| 1016 | Ring Front Surface | (FIG. 31) |
| 1018 | Scheduling Indicia | (FIG. 31) |
| 1020 | Schedule Mark | (FIG. 31) |
| 1022 | Ring Outer Perimeter | (FIG. 31) |
| 1024 | Aperture Diameter | (FIG. 31) |
| 1026 | Ring Aperture | (FIG. 31) |
| 1030 | Support Member | (FIGS. 30, 32, 33, 34) |
| 1032 | Front Surface | (FIGS. 32, 34) |
| 1034 | Back Surface | (FIGS. 33, 34) |
| 1036 | Presssure Sensitive Adhesive | (FIG. 33) |
| 1038 | Support Member Wall | (FIGS. 32, 33, 34) |
| 1042 | Crease Hinge | (FIGS. 30, 32, 33, 34) |
| 1044 | Retention Flap Width | (FIG. 32) |
| 1046 | Next Dose Pointer | (FIG. 32) |
| 1048 | Indicator | (FIGS. 30, 32, 33, 34) |
| 1050 | Intact Body | (FIGS. 32, 34) |

-continued

| Reference Numerals in Drawings | | |
|---|---|---|
| 1054 | Diagonal Dimension | (FIG. 33) |
| 1056 | Retention Flap | (FIGS. 30, 32, 33, 34) |
| 1060 | Lock | (FIGS. 32, 34) |
| 1140 | Standard Medication Carton | (FIG. 30) |
| 1142 | Carton Front Wall | (FIG. 30) |
| 1144 | Front Wall Surface | (FIG. 30) |

DESCRIPTION AND OPERATION

FIGS. 1 through 5D—Preferred Embodiment

With reference now to FIGS. 1 through 5D, a preferred embodiment of the dosage reminder device and medication carton is generally illustrated at 100. The label shown is not part of the invention.

The reminder device 100 (FIGS. 1, 2, 5D) including medication carton 130 is formed from two parts or members: the medication carton member 130 having a structurally defined area in an exterior wall which serves as an indicator and support 140 (indicator/support) for the second member, and a substantially circular movable ring member 110.

The carton and the ring members are preferably manufactured from flexible sheet stock that may be permanently deformed such as paper, cardboard, metal or plastic and may be punched, cut, creased, embossed, debossed, or similarly manufactured. Material otherwise manufactured would also work in many applications. The material is preferably flat, but material that is somewhat flat can be used. One of the members could be manufactured from more rigid and non-deformable material for many applications so long as the two members may be assembled together or retentively engaged with one another. The sheet stock may be put up in rolls for convenience.

The medication carton has a front wall 132, formed from front wall panel 1 in the carton sheet blank (FIG. 1A) and this wall 132 includes a die cut and a permanent deformation characterizing the indicator/support 140. A carton back wall 134 (FIGS. 5B, 5C, 5D) is similarly formed from back wall panel 4 in the blank. The walls are dimensioned to help form a carton interior 136 between them to hold a particular medication.

Figure 1A:
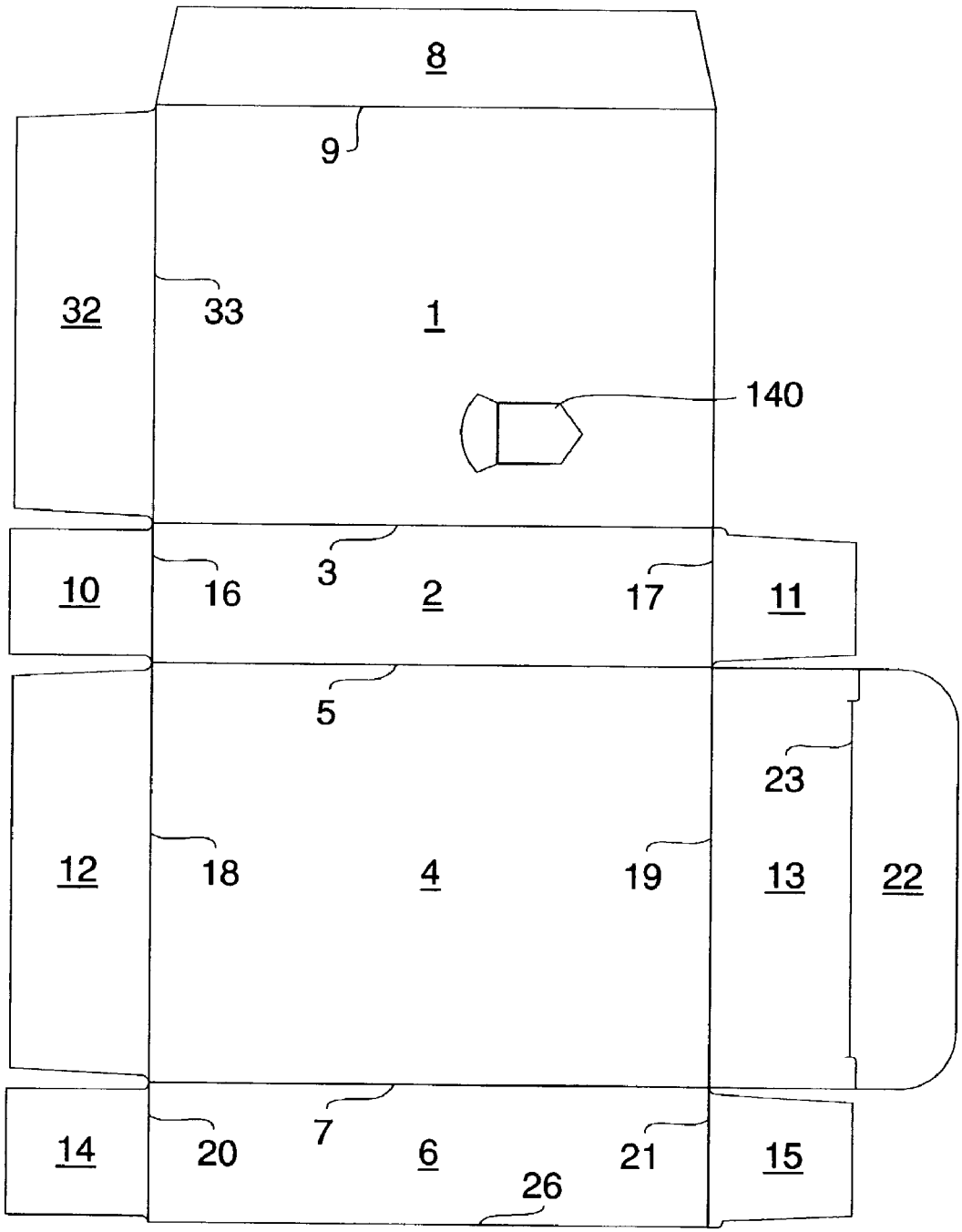
Figure 1B:
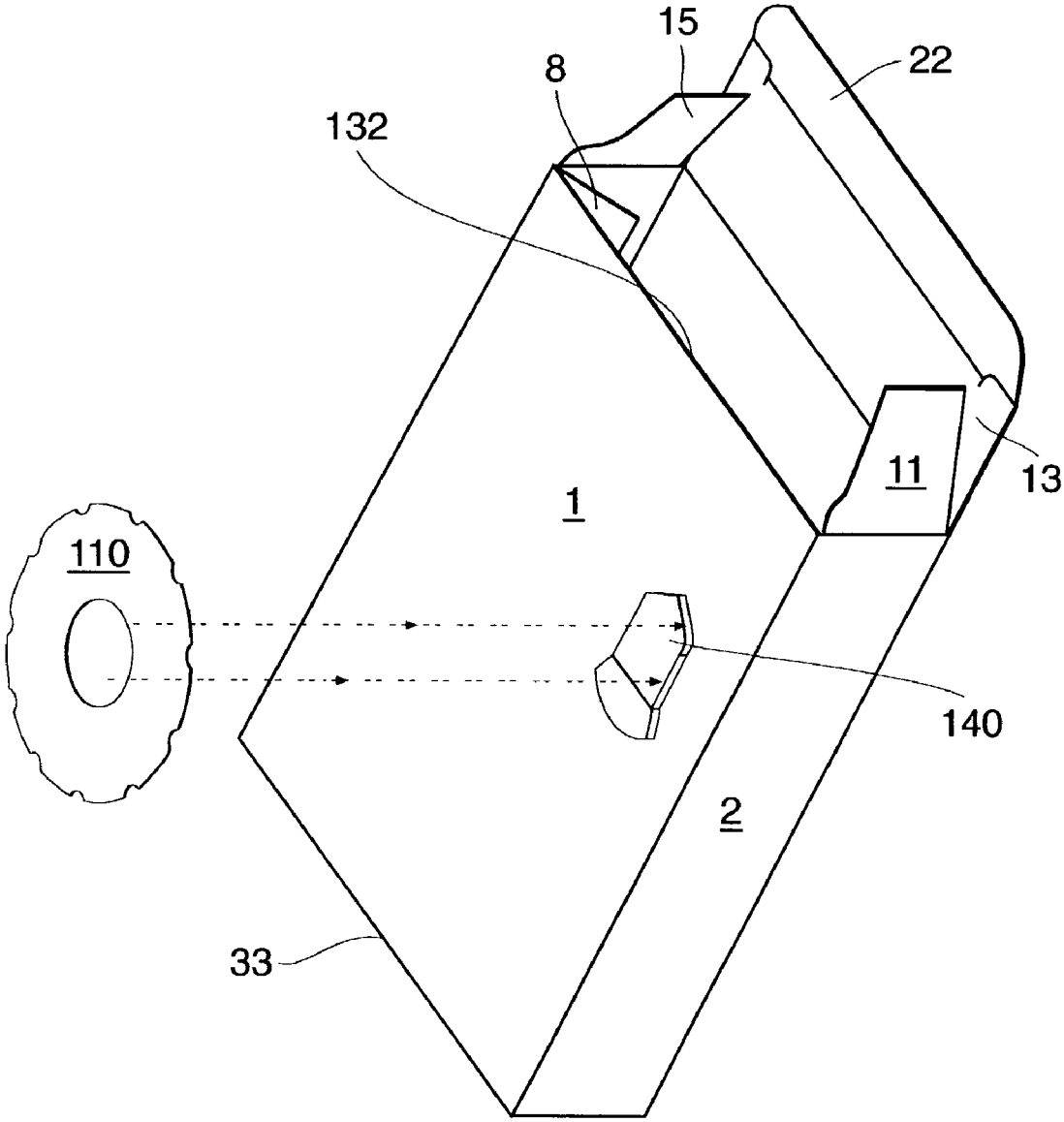
Figure 1C:
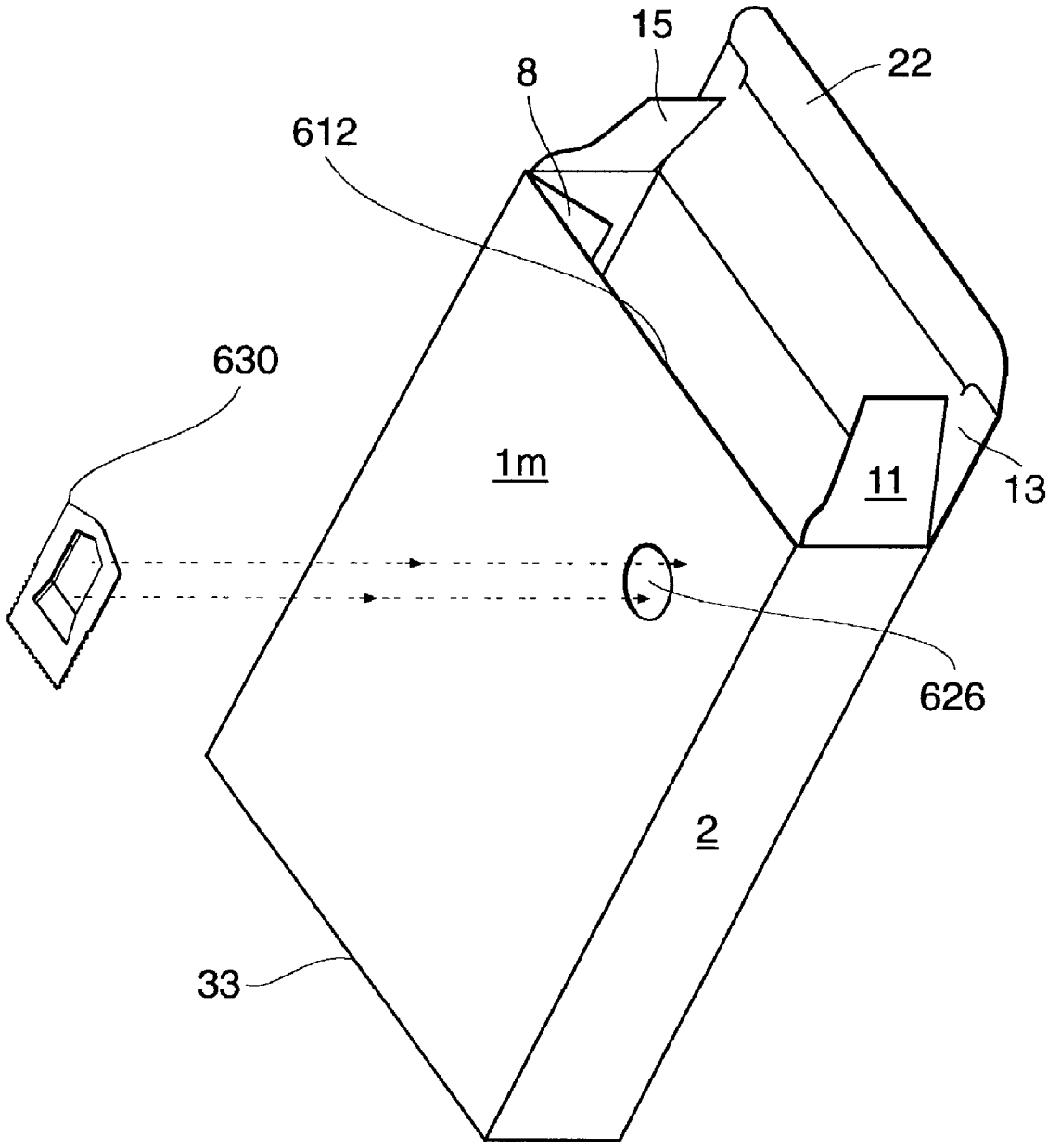

The integral blank of FIG. 1A has a rectangular sleeve-forming portion consisting of four wall-forming panels which are arranged side by side, namely a front wall panel 1, a first sidewall panel 2 connected to the front wall panel 1 along a first folding line 3, a back wall panel 4 connected to the first sidewall panel 2 along a second folding line 5, and a second sidewall panel 6 connected to the back wall panel 4 along a third folding line 7, said folding lines 3, 5, 7 being parallel. The front wall panel 1 has essentially the same dimensions as the back wall panel 4, and the first sidewall panel 2 has essentially the same dimensions as the second sidewall panel 6. When erected, the blank is thus formed into a rectangular parallelepiped.

On one side of the sleeve-forming portion, a closure tab 8 is connected to the front wall panel 1 along a fourth folding line 9.

At each end of the first sidewall panel 2, the back wall panel 4 and the second sidewall panel 6, an end flap 10, 11, 12, 13, 14, 15 is connected to the panel at issue along a folding line t6, 17, 18, 19, 20, 21. One of the end flaps 13 on the back wall panel 4 is in turn connected to a tuck-in tab 22 along a folding line 23. In the front wall panel 1, an end flap 32 on the same end of the sleeve-forming portion as the end flap 10 is connected to the panel along folding line 33. In addition there is a raised or embossed, die cut indicator/support 140 formed from the front wall 132 (FIGS. 3, 5B) of the front wall panel 1. Both the embossing and die cutting processes are well known in the associated manufacturing art.

Figure 2:
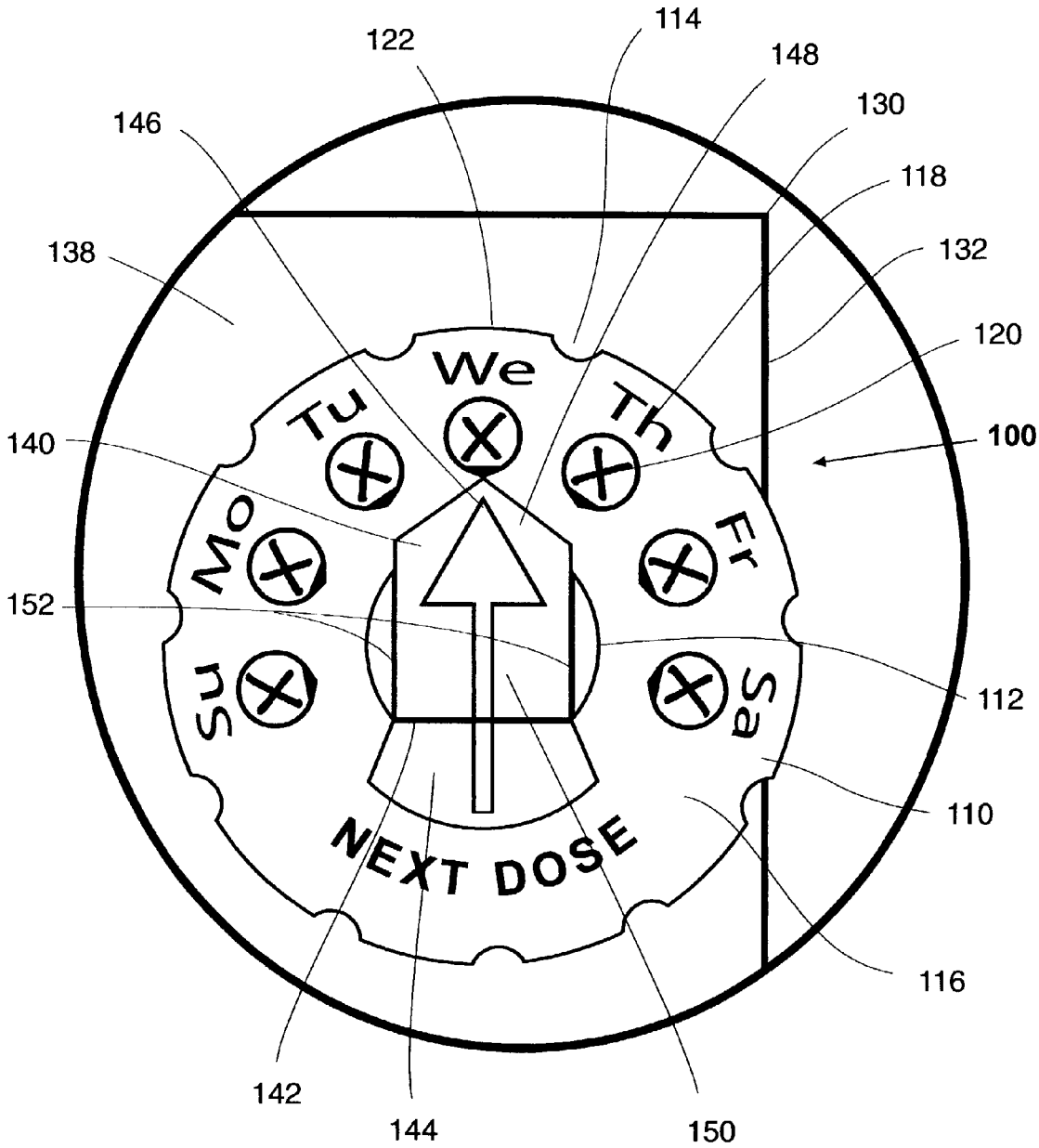
FIG. 2 is an enlarged partial front view of the carton and device of FIG. 1.
Figure 5A:
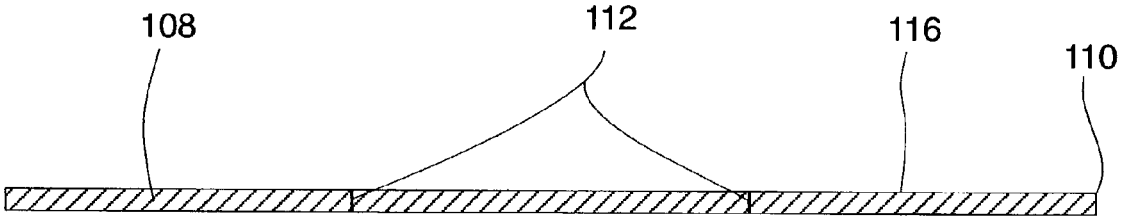
FIG. 5A is an enlarged side cross-sectional view of the ring of FIG. 1.
Figure 5B:
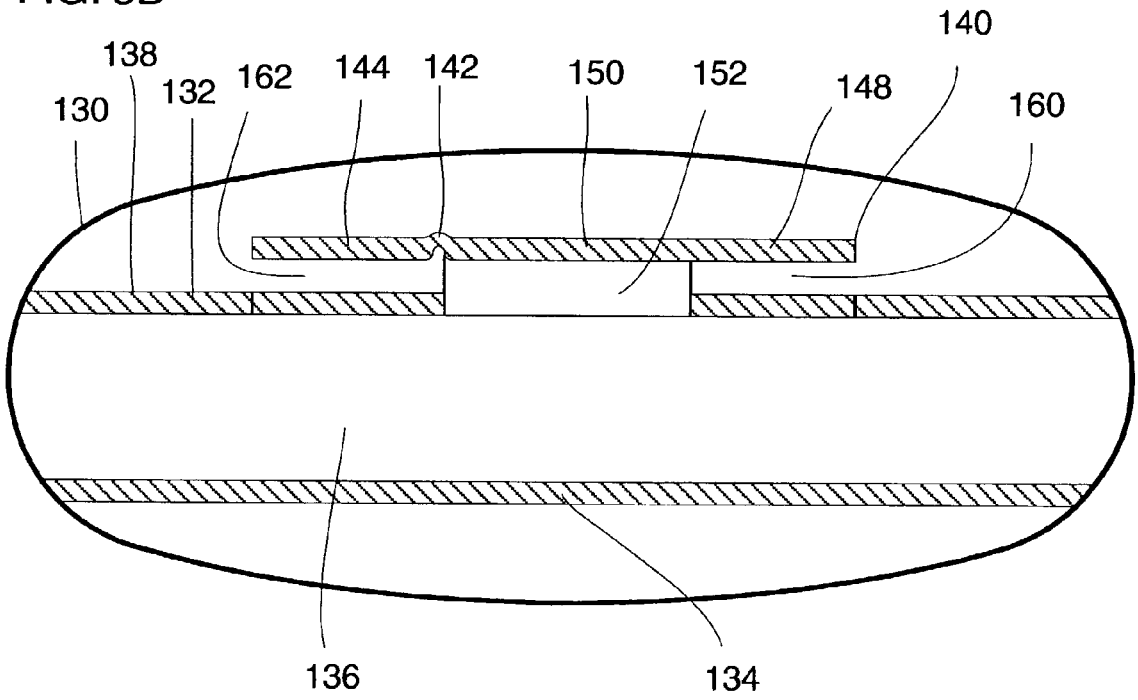
FIG. 5B is an enlarged partial side cross-sectional view of the carton of FIG. 1, showing the indicator/support.
Figure 5C:
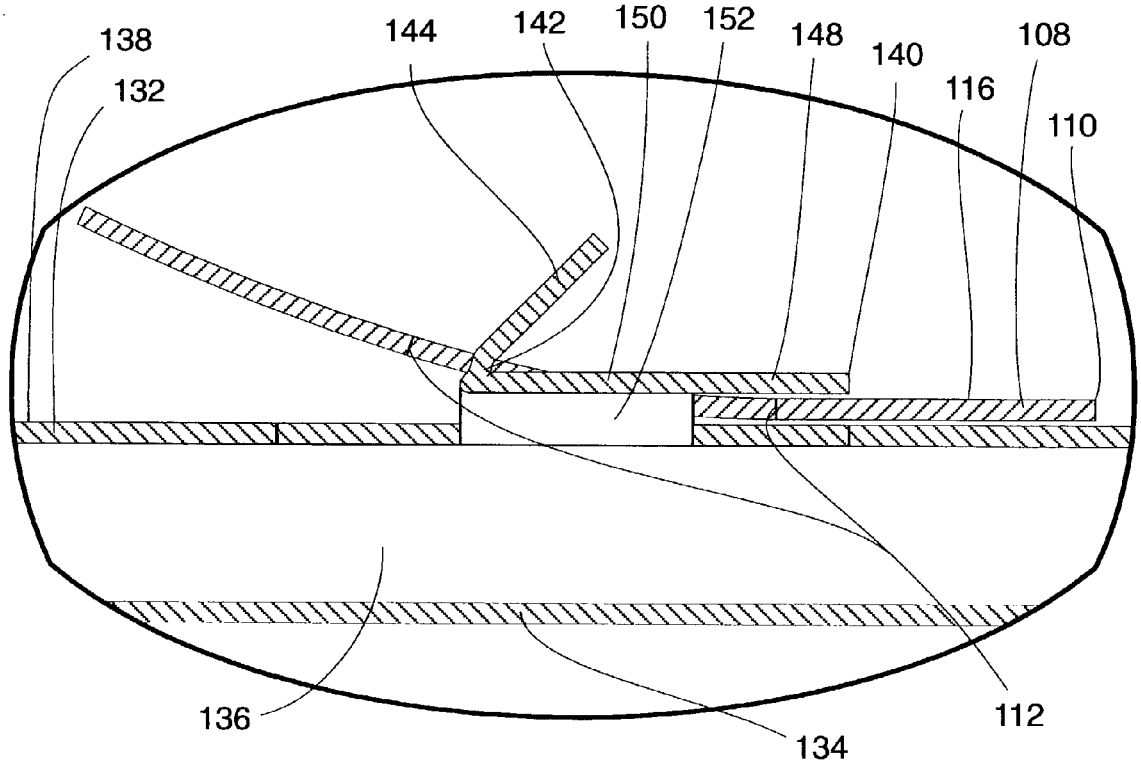
FIG. 5C is an enlarged partial side cross-sectional view, showing the device of FIG. 1 being assembled.
Figure 5D:
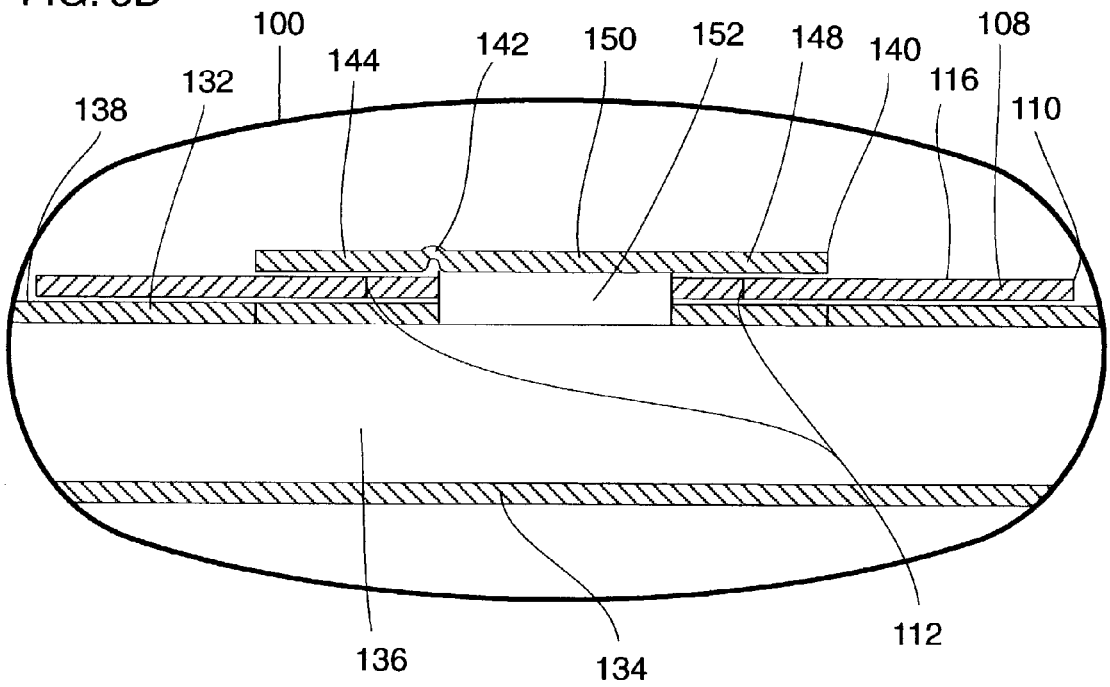
FIG. 5D is an enlarged partial side cross-sectional view of the device of FIG. 1.

The indicator/support 140 includes an indicator body 150, a pointed indicator head 148 and a flared rounded indicator tail 144 that are all raised from the carton wall and rest in a plane that is substantially parallel to the carton wall. The tail widens 156 (FIG. 3) at distance from the body, but remains narrower than diameter 124 (FIG. 4) of ring aperture 126 which is delineated by aperture perimeter 112. Only the indicator body remains directly joined to the front carton wall by side connecting walls 152. The side connecting walls are somewhat perpendicular to the carton wall. Permanent deformation of the wall panel by embossing in the areas of the side connecting walls 152 produces the walls and raises the indicator/support 140 from the surface of the wall panel. This combination of die cutting and embossing also creates open spaces 160 and 162 (FIG. 5B) beneath the head and the tail of the indicator/ support. These spaces are slightly higher than the thickness of ring wall 108 (FIGS. 5A, 5C, 5D). Permanent deformation of the wall panel by creasing in the area of hinge 142 produces the hinge 142 connecting the indicator body to the indicator tail. The side connecting walls determine the ring mounting location and they support the mounted ring. Maximum diagonal distance 154 (FIG. 3) between the side connecting walls is slightly smaller than the diameter of the ring aperture 124. The indicator/support also acts as a next dose pointer and is so indicated 146 (FIGS. 1, 2).

To assemble the carton, the closure tab 8 (FIGS. 1A, 1B) is coated with adhesive and brought into engagement with the second sidewall panel 6, such that the fourth folding line 9 essentially coincides with sidewall panel edge 26. The carton is then erected to form a sleeve, whereupon one end of the sleeve is closed by first folding in the end flaps 10, 14 of the sidewall panels 2, 6 and then folding in the end flap 12 of the back wall panel 4. Finally, flap 32 on this end of the carton is folded down so as to overlie and be fixed to the end flap 12 of the back wall panel 4, preferably by means of adhesive. Subsequently, the carton is loaded with goods, e.g. blister packs and ring mounting instructions as well as the ring member 110 of the reminder device, at the other, open end. After loading, the carton is closed by first folding in the end flaps 11, 15 of the sidewall panels 2, 6 and then folding in the end flap 13 of the back wall panel 4, whereby the tuck-in tab 22 is inserted between the end flaps 11, 15 of the sidewall panels 2, 6 and the front wall panel 1. After purchase the carton is opened and the Pharmacist or user mounts the ring.

The ring member 110 includes a structurally defined area, an essentially circular central aperture 126 (FIG. 4) which serves for retentive engagement of the device members. A ring outer perimeter 122 (FIGS. 1, 2, 4) has a plurality of notches 114 (FIGS. 1, 2, 4). Printed on front surface 116 of the ring are indicating scheduling indicia 118 (FIGS. 1, 2) consisting of days of the week and corresponding boxes that may be inscribed by the Pharmacist or user. A patient establishes his customized dosage schedule in accordance with prescription label L (FIG. 1) instructions by inscribing 120 (FIGS. 1, 2) the scheduling indicia by pen or marker or like means.

The ring is mounted on front wall surface 138 of the carton, by way of retentive engagement with the indicator/support. The side connecting walls of the indicator/support influence movement of the ring and friction between the members maintains the ring position, but the mounted ring may be freely displaced rotationally about the side connecting walls.

Retentive engagement (FIG. 5C) of the ring with the indicator/support is accomplished by: lifting the indicator tail causing it to bend at its hinge, passing the indicator head through the ring aperture, flexing the ring and sliding the aperture perimeter of the ring fully into the space below the indicator head of the indicator/support, lowering the unassembled portion of the ring to the surface of the carton wall and then lowering the hinged tail to substantially its original orientation. The ring is thereby trapped between the pointer and the carton surface. The next dose pointer, the ring, and the carton wall lie in close substantially parallel planes as do the cooperating indicia.

When a patient takes her medication she rotates the mounted ring to align the inscribed next dosage time period on the ring with the next dose pointer on the support. The next dose pointer and the inscribed time period indicia form a reminder indicating when the next dose is due or when the last dose was taken.

Figure 6:
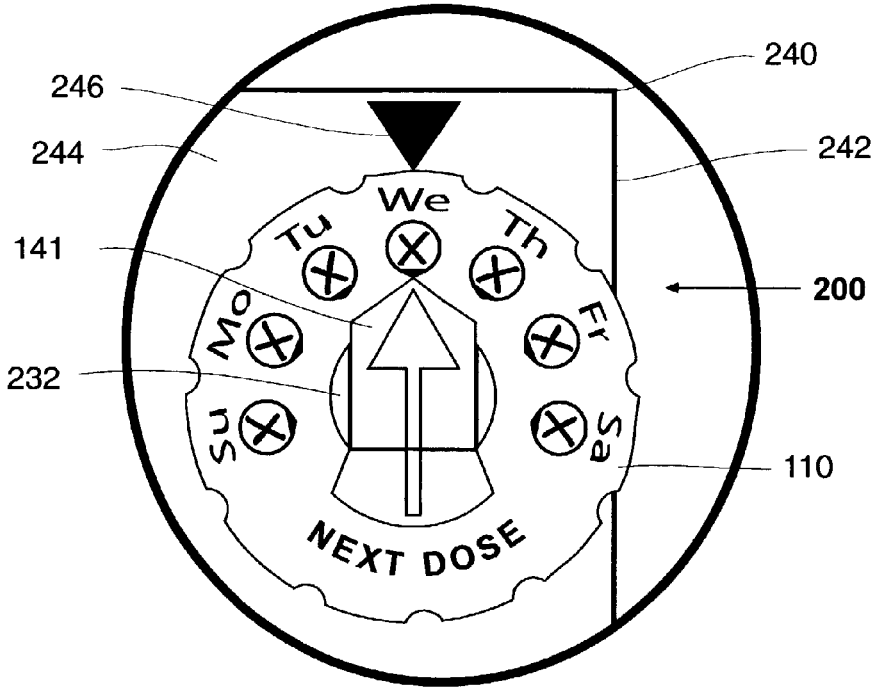
FIG. 6 is a partial front view of an additional second embodiment of my invention. In this example the device is adhesively attached to the wall surface of a standard pre-existing medication carton.
Figure 7A:
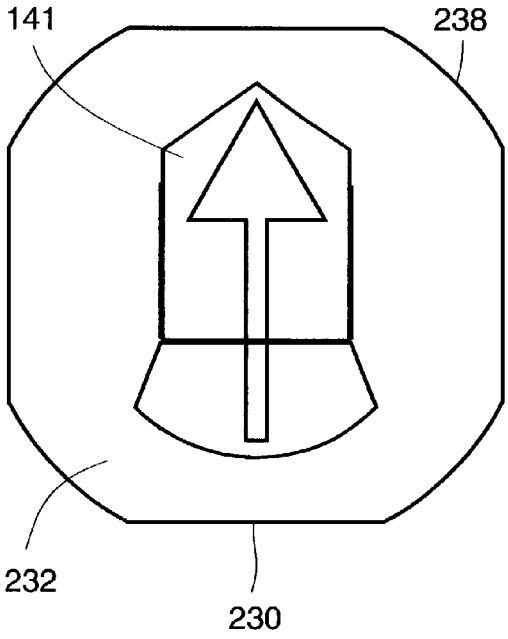
FIG. 7A is an enlarged front view of the substantially rectilinear member of FIG. 6, showing the indicator/support.
Figure 7B:
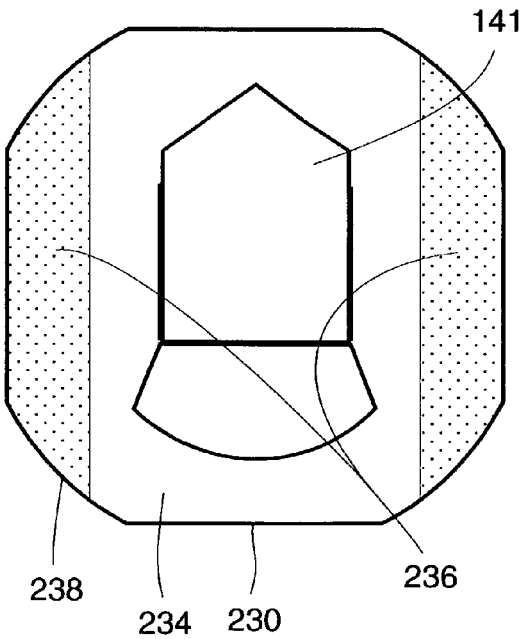
FIG. 7B is a back view of the substantially rectilinear member of FIG. 7A, showing the pressure sensitive adhesive.

FIG. 6—Additional Embodiment

With reference now to FIGS. 6 through 7B, and FIGS. 1 through 5D, an additional second embodiment of the dosage reminder device is generally illustrated at 200. The reminder device 200 (FIG. 6) includes two parts or members: One is a substantially rectilinear support member 230 (FIGS. 7A, 7B) with rounded corners 238. This member being die cut and permanently deformed so as to serve as an indicator and support 141 like the indicator/support 140 of the preferred first embodiment. The other member is the circular movable ring member 110 of the preferred first embodiment. This indicator/support is produced from the substantially rectilinear member by die cutting and embossing in the same manner as the indicator/support of the preferred first embodiment and assembly or retentive engagement of the ring and the new indicator/support is also the same. Cooperating indicia in the assembled device rest in close substantially parallel planes. The device 200 includes means for attaching to a standard pre-existing medication container, carton 240. Back surface 234 of the rectilinear support member retains a coating of pressure sensitive adhesive 236 distributed on either side of the raised indicator/support and avoiding the raised areas. The pressure sensitive adhesive serves to attach the rectilinear member to surface 244 of wall 242 of standard medication carton 240. In the assembled device the ring hides most of front surface 232 of the support member.

Operation of the reminder device 200 is the same as for the reminder device 100 in the preferred embodiment of the invention.

In a variation of this embodiment a pointer 246 appearing on the medication carton surface 244 co-operates with indicia on the ring 110.

Figure 8:
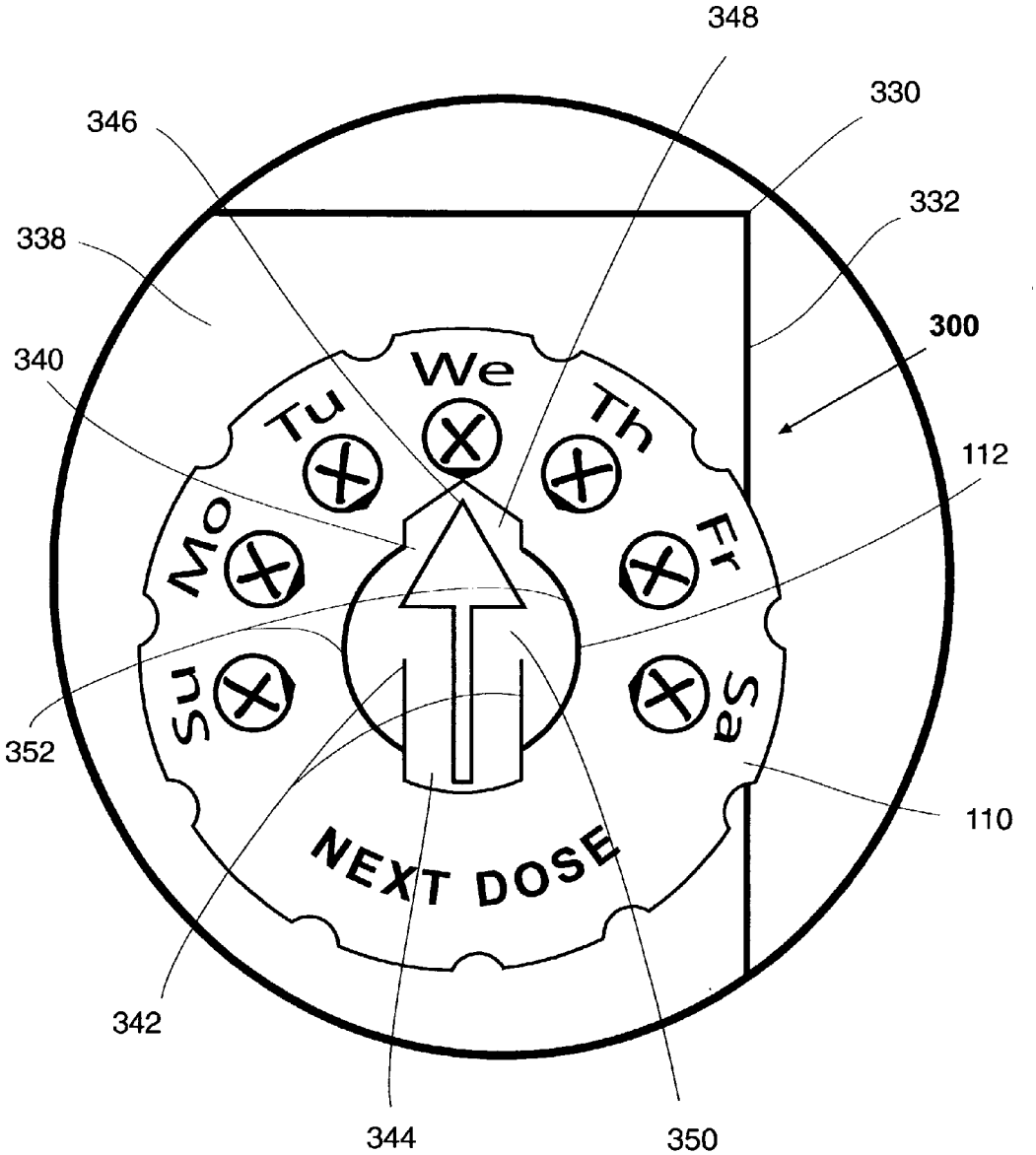
FIG. 8 is a partial front view of an additional third embodiment of my invention. In this example the indicator indicator/support has slits to facilitate assembly with the ring.

FIG. 8—Additional Third Embodiment

With reference now to FIGS. 8 through 10C, and FIGS. 1 through 5A, an additional third embodiment of the dosage reminder device and medication carton is generally illustrated at 300.

The reminder device 300 (FIGS. 8, 10C) including medication carton 330 (FIGS. 8, 9, 10A) is formed from two members. One member is the medication carton 330, which includes a die cut and permanently deformed front wall 332. This structurally defined area in the wall serves as an indicator and support 340 (indicator/support) for the other member. The other member is the movable ring 110 of the preferred embodiment of the invention. The front wall 332, which includes the indicator/support 340 and back wall 334 (FIGS. 10A, 10B, 10C) are dimensioned to help form a carton interior 136 between them to hold a particular medication. This carton is produced in a manner similar to carton 130 and this indicator/support 340 is produced by die cutting and embossing.

Device embodiments 300 and 100 are similar, but their indicator/supports differ slightly in the following respects. The new indicator/support has curved side connecting walls 352 that match the shape of the aperture perimeter 112. The side connecting walls are somewhat perpendicular to the carton wall. The diameter 354 (FIG. 9) of the curved side connecting walls is slightly smaller than that of the ring aperture 124. Indicator tail 344 of the indicator/support is not flared and has slits 342 that extend into indicator body 350 of the indicator/support to facilitate device assembly. Next dose pointer 346 on the indicator/support is equivalent to the next dose pointer 146 in the preferred embodiment of the invention. The ring is mounted on front wall surface 338 by way of assembly or retentive engagement with the indicator/support.

Assembly (FIG. 10B) of the device members is accomplished by passing the indicator tail through the ring aperture, slightly lifting the ring and indicator tail together, and sliding the ring toward head 348 of the indicator until the aperture perimeter passes over the head. The aperture perimeter is then lowered and guided back fully into space 360 under the indicator head and the ring is released. Inherent spring action by the tail pushes the rest of the ring down toward the wall surface of the carton, into space 362 under the indicator tail, and returns the tail to its original orientation. The ring is thereby trapped between the pointer and the carton surface. Co-operating indicia in the assembled device rest in close substantially parallel planes.

Operation of the reminder device 300 is the same as for the reminder device 100 in the preferred embodiment of the invention.

Figure 11:
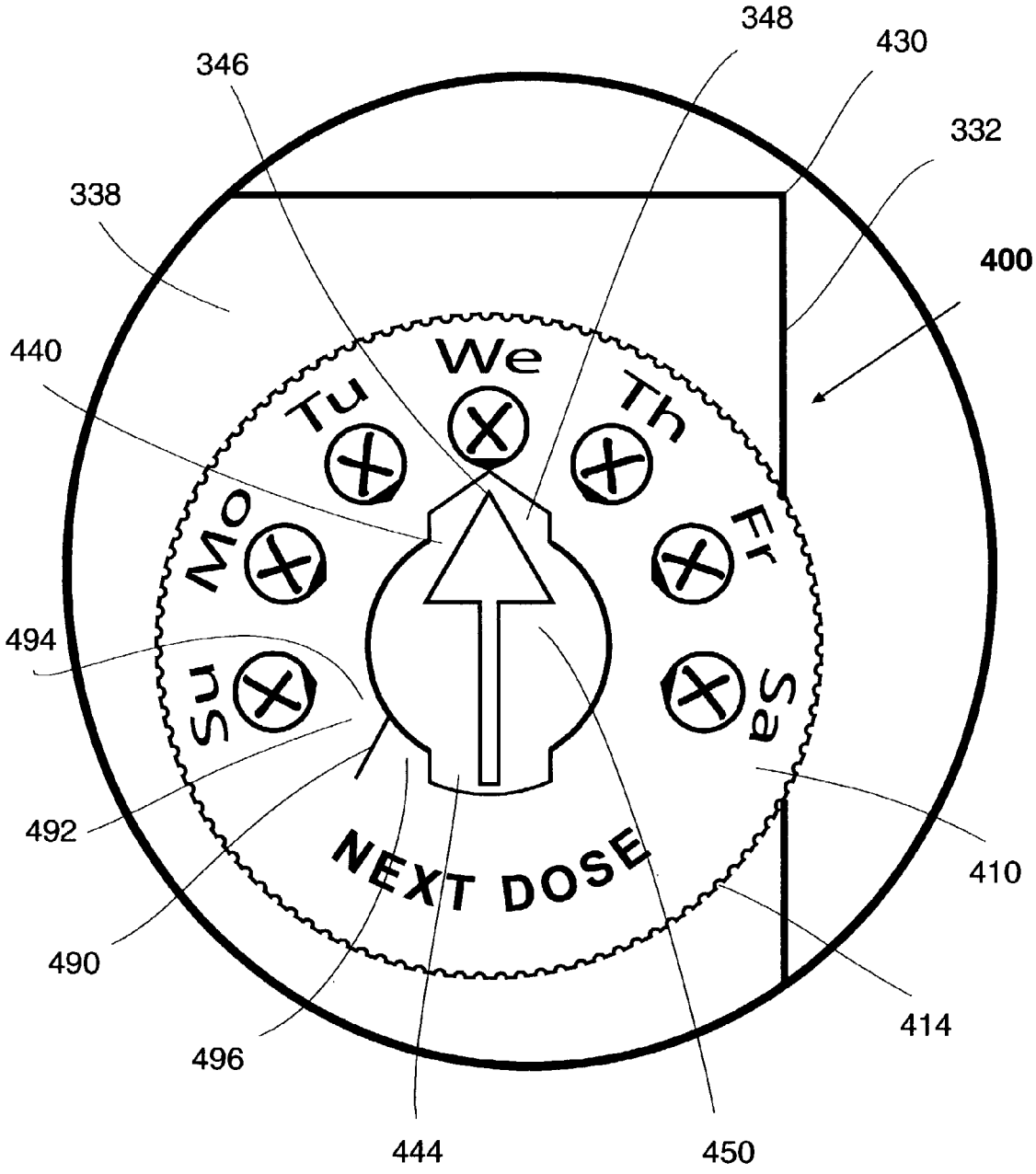
FIG. 11 is a partial front view of an additional fourth embodiment of my invention. In this example the ring is partially split to facilitate assembly with the indicator/support.

FIG. 11—Additional Fourth Embodiment

With reference now to FIGS. 11 through 14, FIGS. 1 through 5A, FIGS. 8 through 10A and 10C, an additional fourth embodiment of the dosage reminder device and medication carton is generally illustrated at 400.

The reminder device 400 (FIG. 11) including medication carton 430 (FIGS. 11, 12, 13) is formed from two members. One member is the medication carton 430 having its front wall 332 die cut and embossed to produce indicator/support 440. The other member is a movable ring 410. This carton and this indicator/support are produced in a similar manner to those in the third additional embodiment 300 of the invention. The new carton and indicator/support are the same in all aspects as those described in the additional third embodiment of the invention except that indicator/support 440 has no slits from indicator tail 444 extending into indicator body 450. Ring 410 is the same in all aspects as the ring 110 in the preferred first embodiment except that instead of having notches at the outer perimeter, the entire outer perimeter of the ring in this embodiment is serrated 414. Ring 410 additionally has partial split 490 starting at aperture perimeter 412 (FIG. 13) of the ring and extending diagonally towards the outer serrated perimeter. The length of the split is sufficient to allow the indicator tail of the indicator/support to pass through the split when the ring is rotated during assembly. The ring is mounted on wall 332 surface 338 of the carton by way of assembly with the indicator/support.

Figure 14:
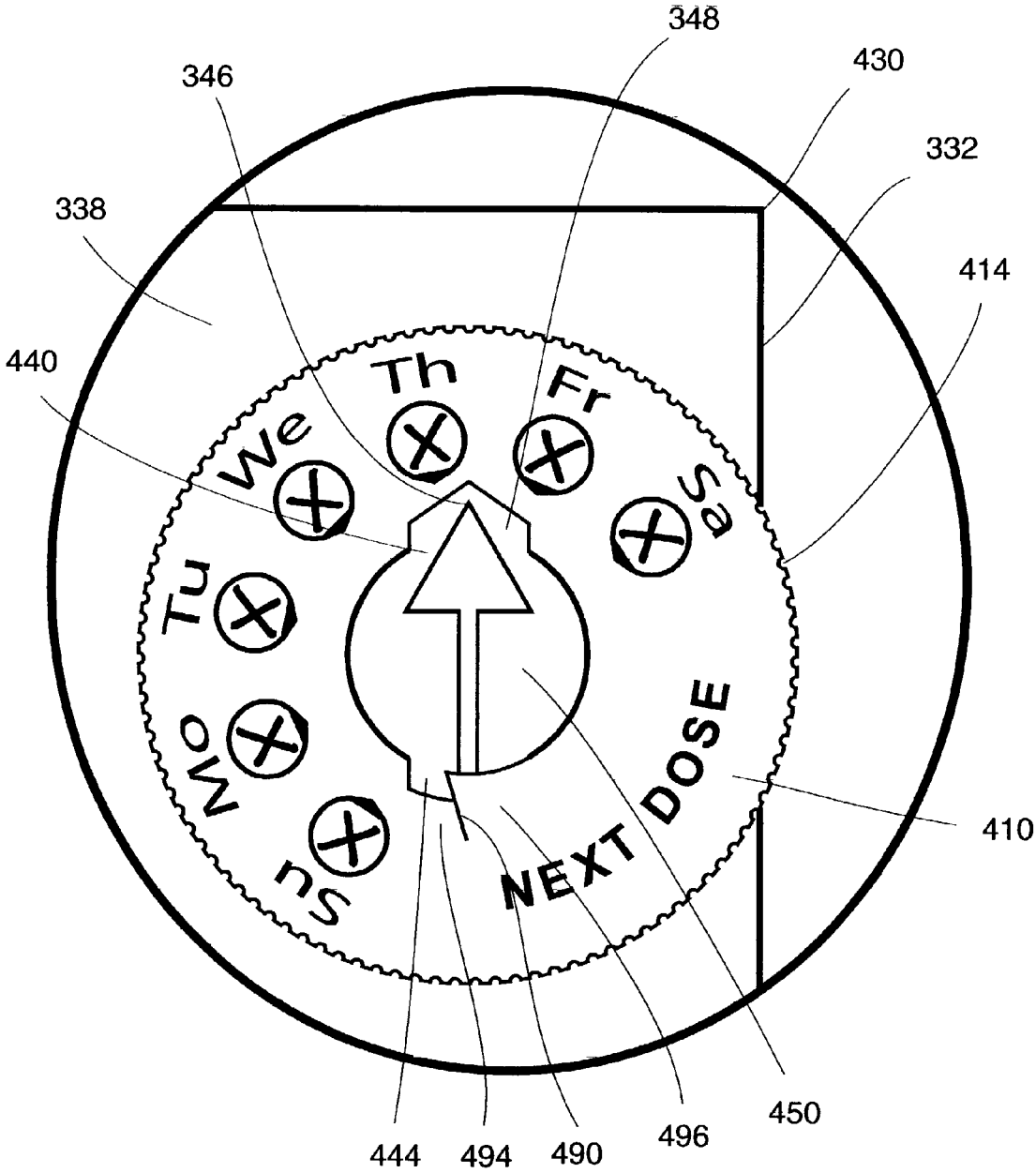
FIG. 14 is a partial front view showing the device of FIG. 11 being assembled.

Assembly of the device members is accomplished by lining up the ring with the indicator/support such that the split in the ring is just to the left of the indicator tail. Indicator head 348 of the indicator/support is passed through aperture 426 of the ring. The aperture perimeter is slipped fully into the space beneath the indicator head and the balance of the ring is allowed to rest on the indicator tail. Downward pressure is applied to the ring at a point 492 just to the left of the split and near the aperture as the ring is rotated in a counter clockwise direction. Pressure is applied until the indicator tail starts to pass through the split in the ring (FIG. 14). Rotation of the ring is continued until the tail passes completely through the split. Both sides 494, 496 of the split will then spring back to their original orientation. The ring is thereby trapped between the pointer and the carton surface. Co-operating indicia in the assembled device rest in close substantially parallel planes.

Operation of the reminder device 400 is the same as for the reminder device 100 in the preferred embodiment of the invention.

Figure 15:
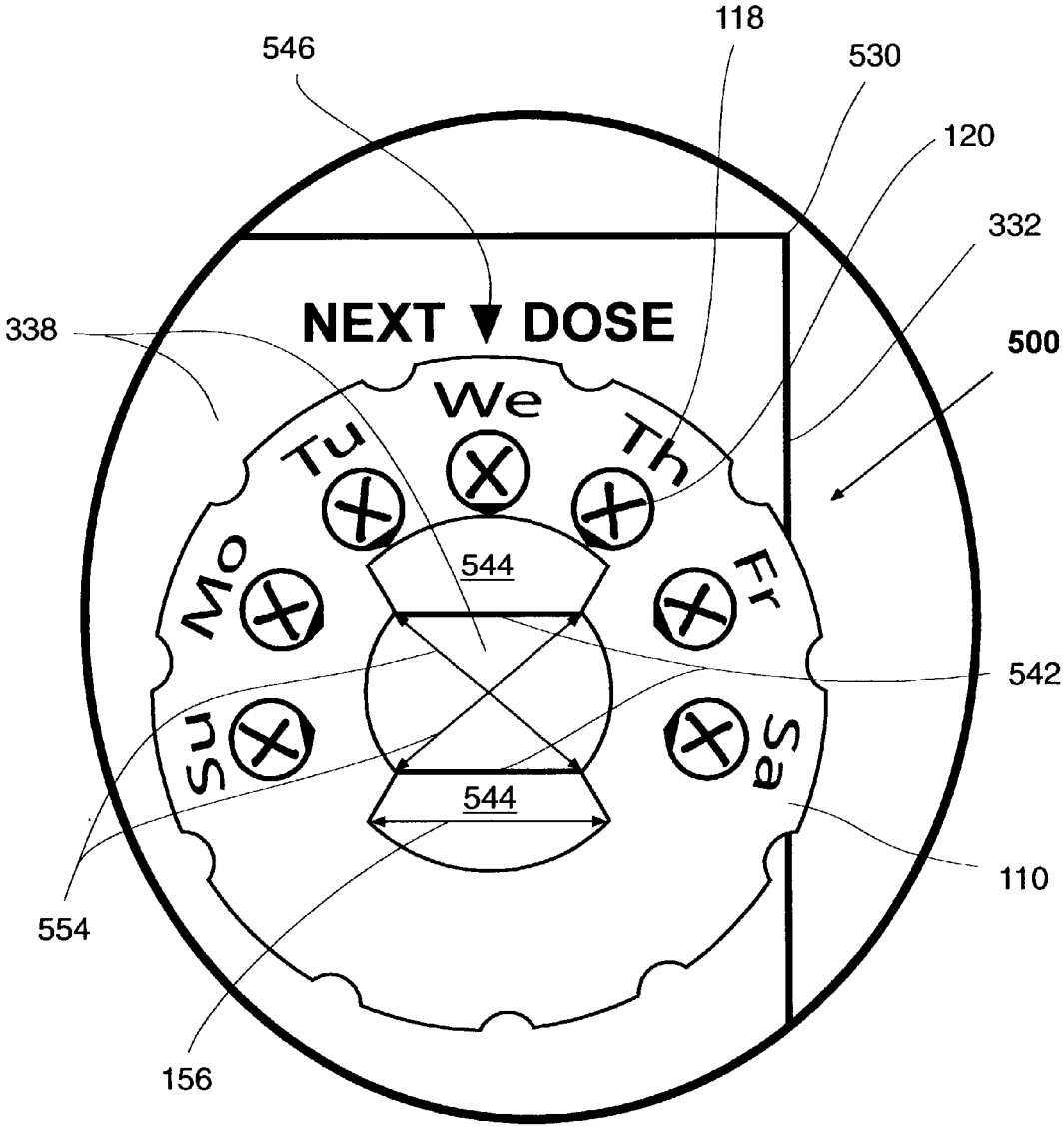
FIG. 15 is a front view of an additional fifth embodiment of my invention. In this example the ring is mounted onto the wall surface of the carton by way of assembly with hinged supports.
Figure 16:
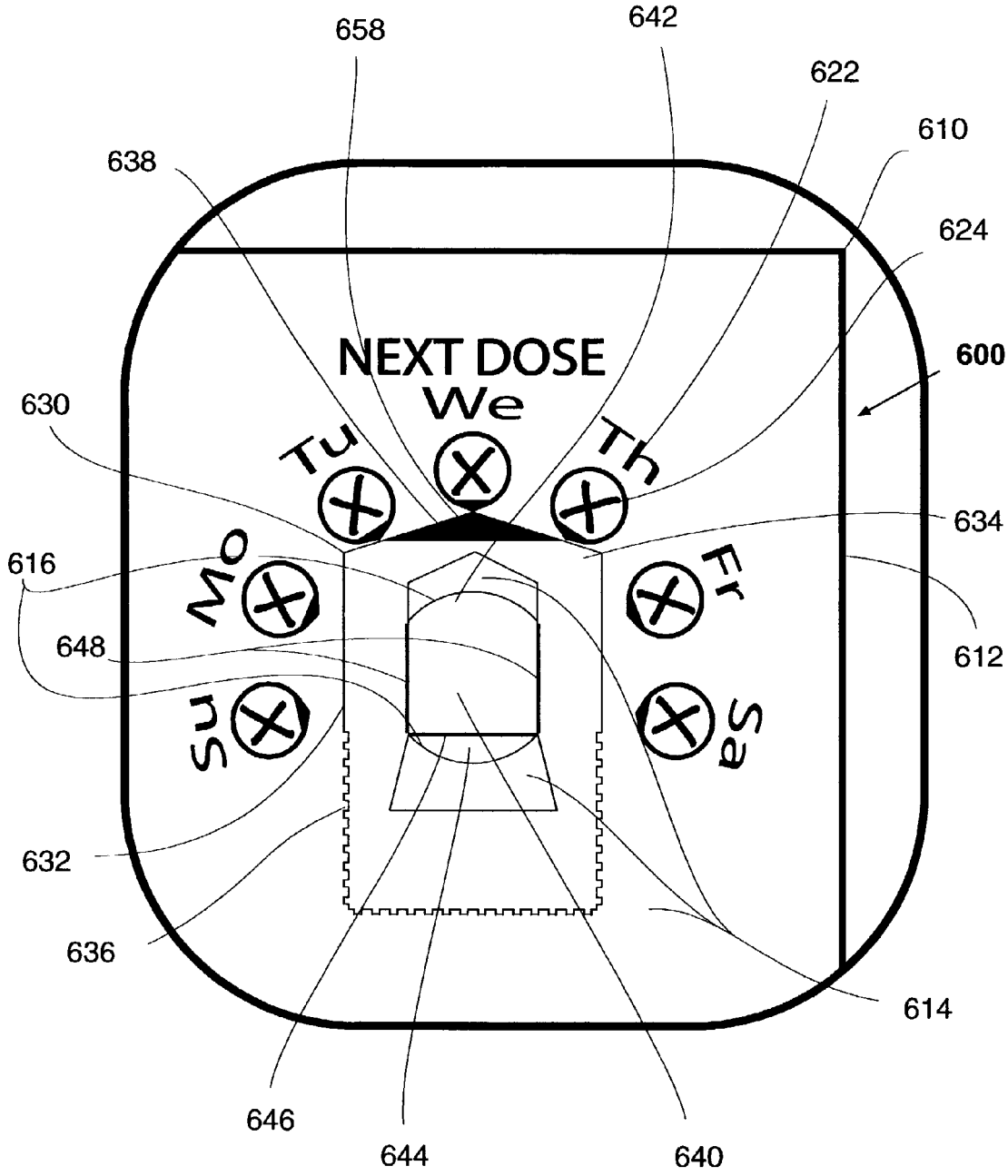
FIG. 16 is a partial front view of a preferred alternative sixth embodiment of my invention. In this example the indicator is assembled with an aperture in the carton wall.

FIG. 15—Additional Fifth Embodiment

With reference now to FIG. 15 and FIGS. 1 through 4, an additional fifth embodiment of the dosage reminder device and medication carton is generally illustrated at 500.

The reminder device 500 (FIG. 15) including medication carton 530 is formed from two members. One of the device members is the medication carton 530 having its front wall 332 die cut and permanently deformed so as to create supports 544 for the other member. Permanent deformation is accomplished by way of creasing the container wall in the areas chosen to produce hinges 542. The combination of die cutting and creasing produces the hinged supports 544 that are connected to the carton wall 332 by the hinges 542. The hinges determine the mounting location of the other member. Maximum diagonal distance between the hinges 554 is the same as the maximum diagonal distance between the side connecting walls 154 in the preferred embodiment of the invention. Wall surface 338 of the carton is further imprinted in order to act as a next dose pointer 546. The other member of the device is the movable ring 110 of the preferred embodiment of the invention.

The ring is mounted on the front wall surface of the carton by way of assembly with the hinged supports. Dimensional relationships between the assembled members that determine mounting position and influence movement are the same as in the preferred embodiment and the mounted ring may be freely rotated about the hinges.

Assembly of the device members is accomplished by lifting both supports and passing them through the aperture of the ring, lowering the ring to the carton wall, and releasing the supports to trap the ring between the supports and the carton wall. Co-operating indicia on the ring and the carton wall rest in close substantially parallel planes.

When a patient takes her medication, she rotates the mounted ring to align the inscribed 120 next dosage time period 118 on the ring with the next dose pointer on the carton 546. The next dose pointer and the inscribed time period indicia form a reminder indicating when the next dose is due or when the last dose was taken.

FIGS. 16 through 19D—Preferred Alternative Embodiment

With reference now to FIGS. 16 through 19D, a preferred alternative sixth embodiment of the dosage reminder device and medication carton is generally illustrated at 600.

Figure 17:
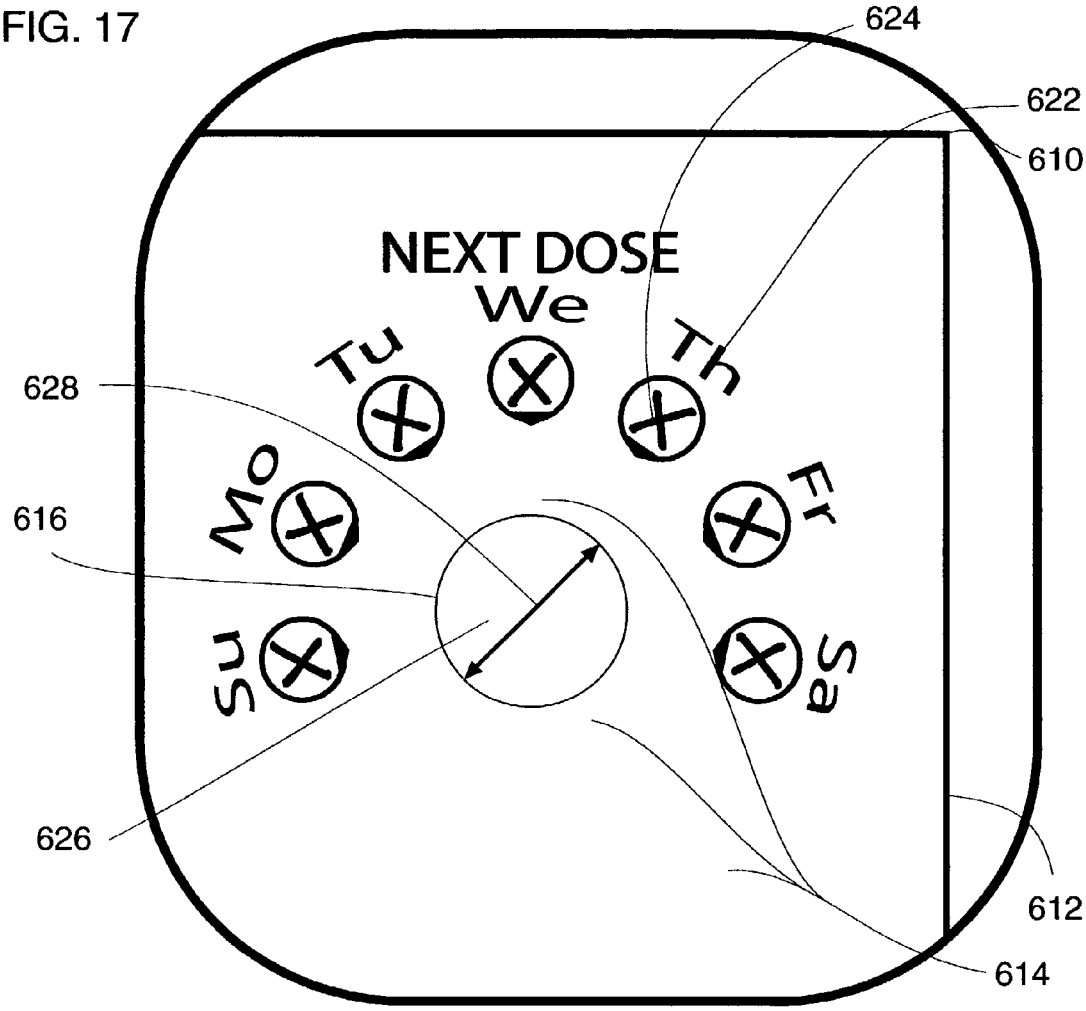
FIG. 17 is a partial front view of the carton of FIG. 16 showing the aperture.
Figure 18:
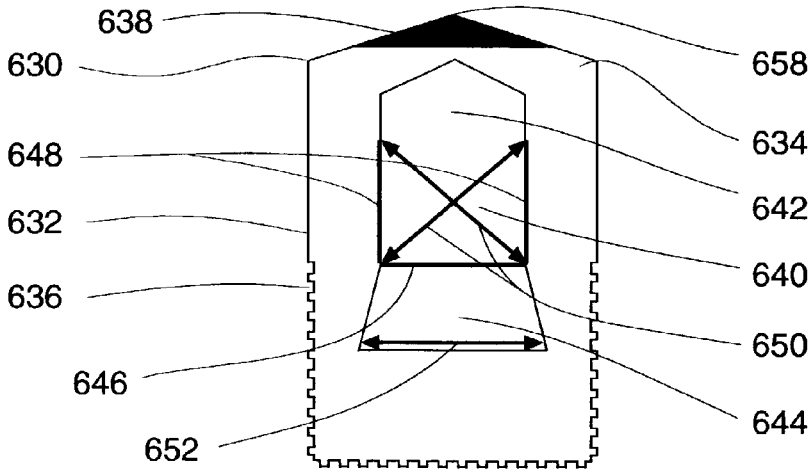
FIG. 18 is a front view of the indicator of FIG. 16.

The reminder device 600 (FIGS. 16, 19D) including medication carton 610 is formed from two parts or members. One is the medication carton member 610 having an essentially circular aperture 626 (FIG. 17). The other is a substantially rectilinear movable indicator member 630 having a pointed 658 upper end.

This medication carton is erected in the same manner and from a similar blank as the medication carton in the preferred embodiment of the invention. Instead of the indicator/support in the front wall of the erected carton the new erected carton (FIG. 1C) has an essentially circular die cut aperture 626 in its front wall panel 1*m* for assembly or retentive engagement with the indicator member 630.

Figure 19A:
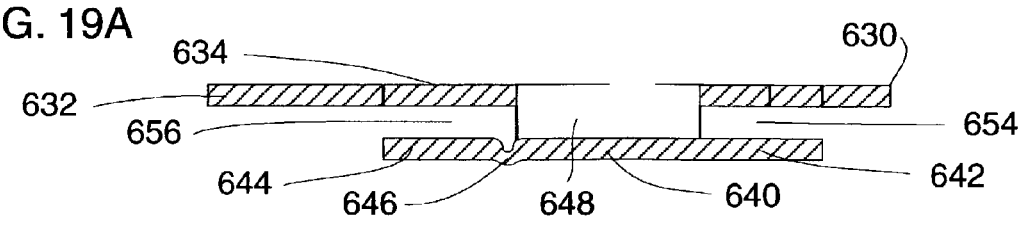
FIG. 19A is an enlarged partial side cross-sectional view of the indicator in FIG. 16.
Figure 19B:
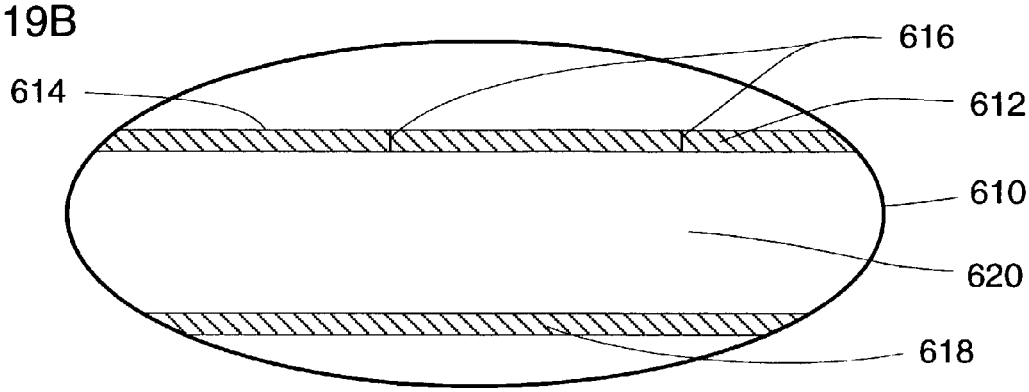
FIG. 19B is an enlarged partial side cross-sectional view of the carton in FIG. 16, showing the aperture perimeter.
Figure 19C:
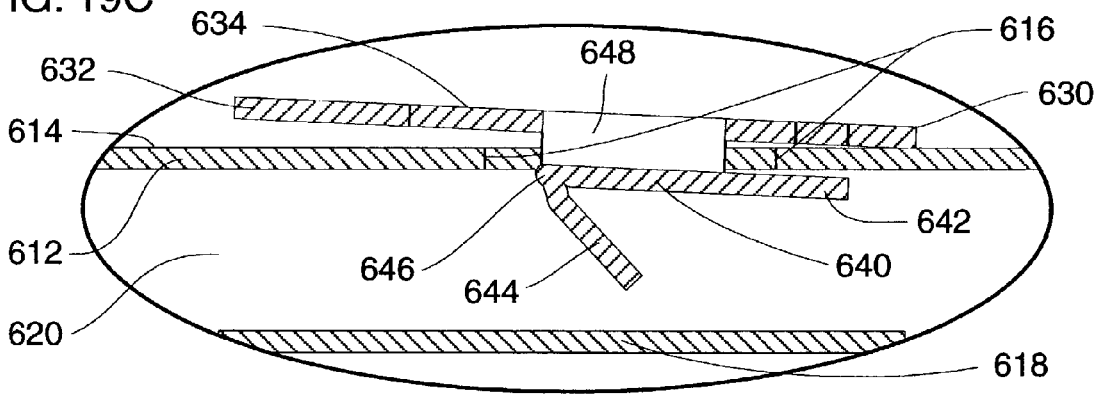
FIG. 19C is an enlarged partial side cross-sectional view of the device of FIG. 16 being assembled.
Figure 19D:
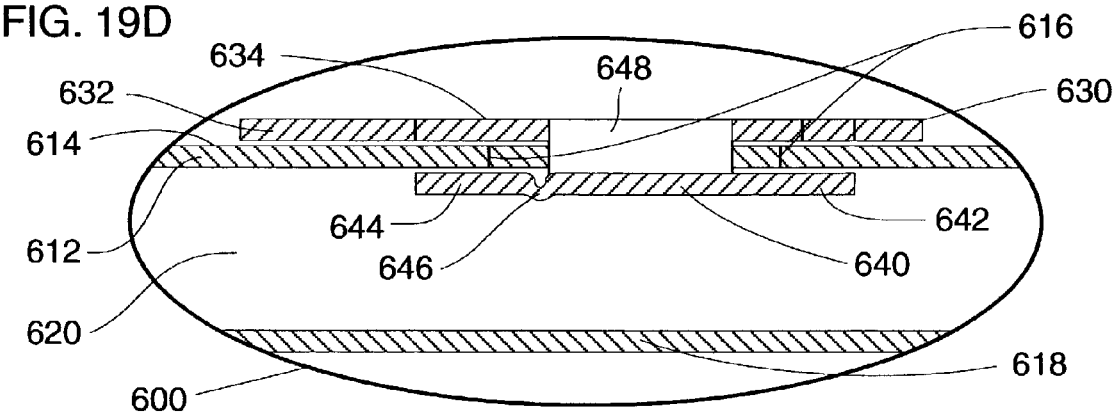
FIG. 19D is an enlarged partial side cross-sectional view of the device of FIG. 16.
Figure 20:
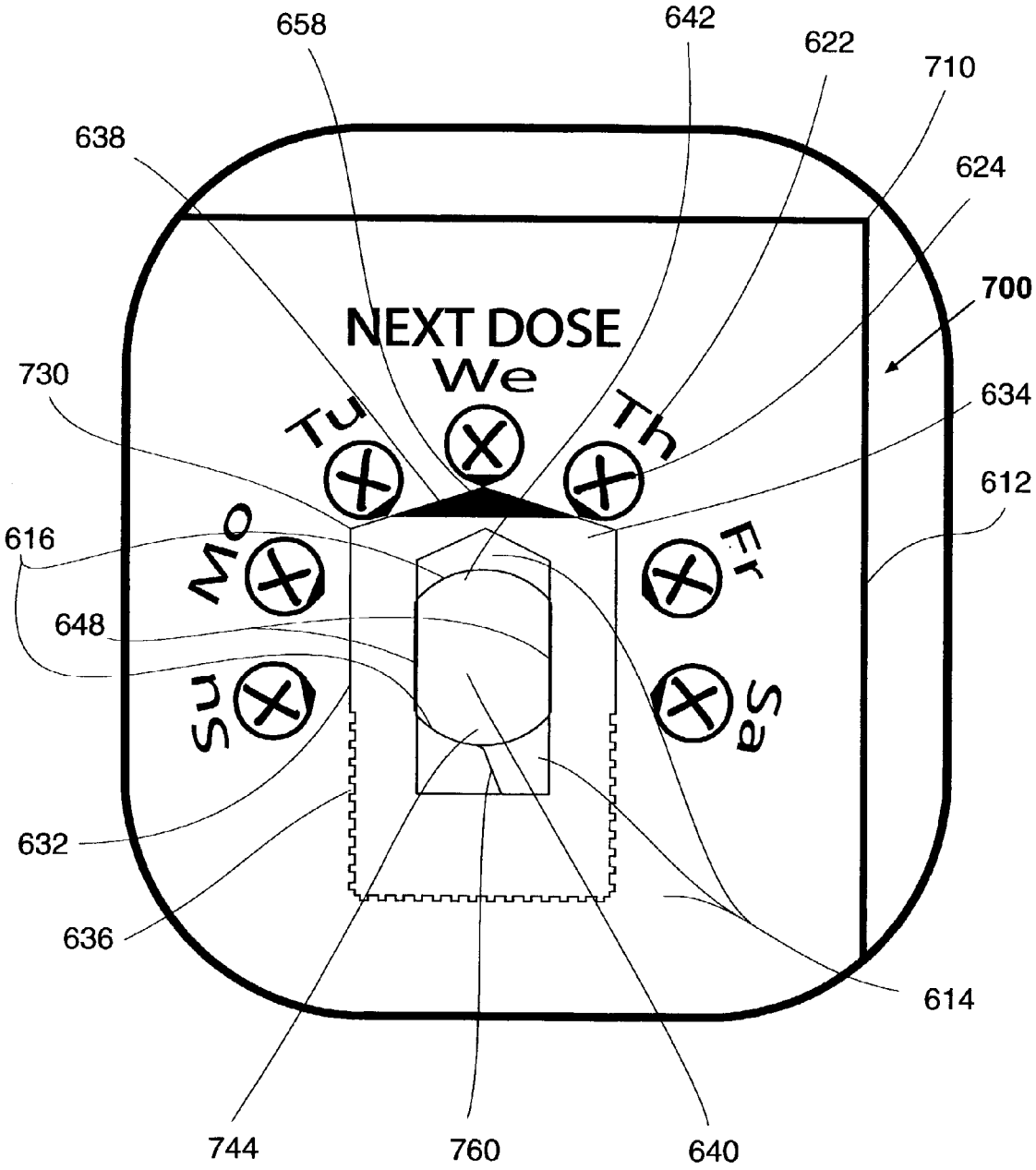
FIG. 20 is a partial front view of an additional alternative seventh embodiment of my invention.

Flat front wall 612 of the carton is formed from the front wall panel 1*m* of the new blank, which includes the aperture 626. The carton also has a back wall 618 (FIGS. 19B, 19C, 19D). The walls are dimensioned to help form a carton interior 620 between them to hold a particular medication.

The carton aperture determines the indicator 630 mounting location and supports the mounted indicator. Printed on the surface 614 of the carton front wall are indicating scheduling indicia 622 (FIGS. 16,17), consisting of days of the week and corresponding boxes that may be inscribed by the Pharmacist or user. A patient establishes his customized dosage schedule in accordance with prescription label instructions by inscribing 624 (FIGS. 16,17) the scheduling indicia by pen or marker or like means.

The indicator 630 is produced by die cutting and permanently deforming indicator wall 632 to create the indicator shape and define a formed mounting shape or structural area for assembly or retentive engagement. Deformation of the wall is accomplished through creasing and debossing, This combination of cutting and permanent deformation produce an arrangement that facilitates retentive engagement of the members. The formed mounting shape lies in a lowered plane that is substantially parallel to the indicator wall 632 and includes a mounting body 640, a pointed mounting head 642 at its upper end, and a flared mounting tail 644 at its lower end. The head points in the same direction as the upper end of the wall. The tail widens 652 (FIG. 18) at distance from the body, but remains narrower than diameter 628 (FIG. 4) of carton aperture 626 which is delineated by aperture perimeter 616. Only the body remains directly connected to the indicator wall by side connecting walls 648. The side connecting walls are somewhat perpendicular to the indicator wall. Maximum diagonal distance 650 (FIG. 18) between the side connecting walls is slightly smaller than the diameter of the carton aperture. Debossing creates the side connecting walls as well as open spaces 654 and 656 (FIG. 19A) above the head and the tail of the indicator. These spaces are slightly taller than the carton wall thickness.

Creasing produces hinge 646 connecting the body to the tail. The indicator acts as a next dose pointer and wall front surface 634 is so indicated 638 (FIGS. 16, 17) at its upper end. The indicator is also serrated along outer perimeter 636 around its lower end to facilitate gripping by a fingernail.

The indicator member is mounted on the front wall surface of the carton by way of assembly with the carton aperture. The aperture influences movement of the indicator and friction between the members maintains the indicator position, but the indicator may otherwise be freely rotated within the aperture.

Assembly (FIG. 19C) of the indicator with the carton aperture is accomplished by: pulling down the mounting shape tail causing it to bend at its hinge, passing the head through the carton aperture and lowering the remainder of the indicator along with the bent tail to rest on the carton wall surface. The indicator is then slid forward and lowered until the carton wall is fully inserted into the spaces above the head and the tail. Inherent spring action by the hinge returns the tail substantially towards its original orientation. The indicator is thereby trapped in the carton aperture, but may otherwise be freely rotated. The pointer and the carton wall rest in close substantially parallel planes as do the co-operating indicia.

In operation, when a patient takes her medication she rotates the mounted indicator to align the next dose pointer on the indicator with the inscribed next dosage time period on the carton. The next dose pointer and the inscribed time period indicia form a reminder indicating when the next dose is due or when the last dose was taken.

FIGS. 20 through 23—Additional Alternative Embodiment

With reference now to FIGS. 20 through 23 and FIGS. 16 through 19D, an additional alternative seventh embodiment of the dosage reminder device and medication carton is generally illustrated at 700.

The reminder device 700 (FIG. 20) including medication carton 710 is formed from two members. One member is an indicator 730, which is almost the same as indicator 630 of the preferred alternative sixth embodiment, but mounting shape tail 744 of the new indicator is not flared and there is no hinge. The other member is the medication carton 710, being the same in all respects as medication carton 610 of the preferred alternative sixth embodiment, with one exception. The new medication carton has a partial split 760 in the carton front wall that extends diagonally from the perimeter of the carton aperture. The length of the split is sufficient to allow the tail of the mounting shape to pass through the split when the indicator is rotated during assembly with the carton aperture. The indicator in this embodiment is also mounted on the wall surface of the carton by way of assembly with the carton aperture.

Assembly of the device members is accomplished by lining up the indicator over the carton aperture such that the tail of the mounting shape is just to the right of the split in the carton. The mounting head is passed through the carton aperture and the indicator is slid forward until the carton wall is fully inserted into the space above the head. The rest of the indicator is then lowered to the surface of the carton wall. Downward pressure is applied to the tail as the indicator is rotated in a clockwise manner until the tail starts to pass through the now opened split in the carton wall. Rotation of the indicator is continued until the tail passes completely through the split. Inherent spring action returns the right and left sides of the split wall to substantially their original orientation. The indicator is thereby trapped in the aperture, but may otherwise be freely rotated. Co-operating indicia in the assembled device rest in close substantially parallel planes.

Operation of the reminder device 700 is the same as for the reminder device 600 in the preferred alternative sixth embodiment of the invention.

FIGS. 24 through 26C—Additional Alternative Eighth Embodiment

With reference now to FIGS. 24 through 26C, FIGS. 16 through 19D, and FIG. 22, an additional alternative eighth embodiment of the dosage reminder device and medication carton is generally illustrated at 800.

The reminder device 800 (FIG. 24) including medication carton 610 is formed from two members. One member is the medication carton 610 of the preferred alternative sixth embodiment of the invention. The other member is indicator 830, which is similar in many respects to indicator 730 of the additional alternative seventh embodiment. What differs in this new indicator is the mounting shape formed from the indicator wall 632 and the method of assembly with the carton aperture. Permanent deformation in this new indicator is characterized by an essentially circular bubble or blister 872 mounting shape formed from the indicator wall. The blister size is matched to the aperture 626 (FIG. 17) in the carton wall. The blister is produced by deformation means previously described or in the case of plastic materials may be produced by vacuum forming or other molding means well known in the associated manufacturing art. Blister bottom 880 (FIG. 26A) lies in a plane that is substantially parallel to the indicator wall and is continuously joined to the indicator wall by a side connecting wall 878, along perimeter 848, running the entire circumference of the blister. The side connecting wall is somewhat perpendicular to the indicator wall and has a first outside diameter 870, which is slightly smaller than the aperture in the carton and is nearest to the indicator wall. The side connecting wall also has a second outside diameter 874, which is slightly larger than the carton aperture and is nearest to the blister bottom. Length 876 of the side connecting wall, having the first outside diameter, is slightly greater than the carton wall thickness 612. The indicator is mounted on the surface of the carton by way of assembly with the carton aperture.

Assembly is accomplished by positioning the blister over the carton aperture 626 and applying downward pressure to snap the blister into the aperture. The side connecting wall flexes inward as the wider diameter section is forced past the carton wall. It then springs back to trap the indicator in the aperture. The indicator may otherwise be freely rotated. Co-operating indicia in the assembled device rest in close substantially parallel planes.

Operation of the reminder device 800 is the same as for the reminder device 600 of the preferred alternative sixth embodiment of the invention.

FIGS. 27 through 29—Additional Alternative Ninth Embodiment

With reference now to FIGS. 27 through 29, an additional alternative ninth embodiment of the dosage reminder device is generally illustrated at 900.

The reminder device 900 (FIG. 27) including medication blister card package 910 is formed from two members. One member is the medication blister card 910 including a portion 908 having a plurality of blister cavities 920 for holding medication (i.e. tablets). The blister card also includes a somewhat flat portion 906 in which there is defined a structural area for retentive engagement with a second member. The second member is a movable indicator produced from previously described sheet material. The indicator is die cut and permanently deformed to facilitate retentive engagement with the blister card and also defines a structural area for retentive engagement with the first member.

The indicator 930 is substantially rectilinear having two side retention flaps 942 separated by a center portion 940 carrying an indicator pointer 938 on front surface 934. The side flaps are joined to the center portion by hinges 946 produced in the indicator wall 932 by deforming or creasing the wall. Notches 948 at the upper and lower perimeter of the indicator coincide with the hinges producing hinges that are shorter 950 than the height of the indicator 952.

The blister card 910 includes a substantially rectilinear aperture 926 in its wall 912 for retentive engagement with the indicator and this aperture is joined to a second narrow width aperture 956 at one end. Aperture height 928, the distance between upper perimeter 916*a* and lower perimeter 916*b* of the aperture 926, is slightly bigger than dimension 950 (height) of the indicator hinges but slightly smaller than dimension 952 (height) of the indicator 930. Dimension 954 (height) of the second aperture 956 is slightly bigger than the height 952 of the indicator 930. The width of the second aperture is slightly larger than the thickness of the indicator wall 932.

Anti-displacement means is provided for the assembled indicator by serration at the lower perimeter 916*b* of the aperture. Front surface 914 of the blister card further carries dosage time period indicia 922 that may be inscribed 924 by a Pharmacist or user to establish a dosage schedule, in accordance with prescribed label instructions.

Assembly of the device members is accomplished by passing the leftmost hinged side retention flap through the second aperture 950 from front to back of the blister card wall 912 until the hinge reaches the blister wall. The indicator 934 is then displaced latterly to the left ensuring that the inserted flap remains behind the card wall and the center portion of the indicator remains in front. Lateral displacement of the indicator is continued until the rightmost retention flap may be bent and passed through the blister card wall in a fashion similar to the leftmost retention flap. Further lateral displacement of the indicator traps the indicator in the blister card wall. Inherent spring action produced by the hinges returns the flaps to a position close to the back of the blister card wall. The indicator 934 may be displaced laterally within the aperture 926 when dislocated from the serrated lower perimeter of the aperture. The co-operating indicia in the device 900 rest in close substantially parallel planes.

When a patient takes her medication she raises the indicator 938 longitudinally along the surface of the card to dislocate the indicator 934 from the serrated lower perimeter 916*b* of the aperture 926 and slides the mounted indicator laterally to align the next dose pointer 938 on the indicator with the inscribed 924 next dosage time period 922 on the blister card. The indicator is then relocated to the serrated lower perimeter of the aperture. The next dose pointer and the inscribed time period indicia form a reminder indicating when the next dose is due or when the last dose was taken.

FIGS. 30 through 34—Additional Tenth Embodiment

With reference now to FIGS. 30 through 34, an additional tenth embodiment of the dosage reminder device is generally illustrated at 1000.

The reminder device 1000 (FIG. 30) includes two parts or members: One is a substantially rectilinear support member 1030 (FIGS. 30, 32) which is die cut and permanently deformed to facilitate retentive engagement with the second member. The second member is a movable substantially circular ring member 1010 having an essentially circular central aperture 1026 for retentive engagement with the support member.

A defined structural area for engagement is produced in support member wall 1038 by die cutting and creasing. The die cuts in the support member wall produce a pointed indicator 1048 and a flared retention flap 1056, separated by an intact horizontal body 1050 extending to the perimeters of the support member. The die cuts are such that the maximum diagonal distance 1054 on the intact body measured from the indicator 1048 to the retention flap 1056 is slightly less than diameter 1024 of ring aperture 1026. The retention flap 1056 widens 1044 at distance from the intact body 1050 but remains sufficiently narrower than the ring aperture diameter 1024 to permit assembly of the members. The support member also includes a die cut u-shaped antidisplacement lock 1060 constructed to accommodate extensions 1014 on outer perimeter 1022 of the movable ring 1010. The support member also acts as a next dose pointer and is so indicated 1046 on front surface 1032. Creases 1042 delineating the intact horizontal body 1050 extend from the indicator 1048 die cuts to the perimeters and across the entire support at the retention flap 1056. Creases at the lock 1060 extend horizontally from the u-shaped opening in the lock to the support perimeters. Creases facilitate assembly by permitting the support member to bend at their locations. This readily exposes the structural areas to be engaged by the ring member 1010 and makes for easy assembly. After assembly the bent portions are returned to substantially their original orientation. Creases at the lock 1060 and the retention flap 1056 create hinges for these elements that permit them to be raised and lowered repeatedly if necessary. The device 1000 includes means for attaching to a standard pre-existing medication container, carton 1140. Back surface 1034 of the support member retains a coating of pressure sensitive adhesive 1036 distributed on either side of the indicator 1048 and avoiding the retention flap 1056 and the lock 1060. The pressure sensitive adhesive serves to attach the support member 1030 to surface 1144 of wall 1142 of the medication carton 1140.

The plurality of extensions 1014 at the outer perimeter 1022 (FIGS. 31) of the movable ring member 1010 provide a convenient means for grasping the ring. Printed on front surface 1016 of the ring are indicating scheduling indicia 118 (FIGS. 30, 31) consisting of daily time periods and corresponding boxes that may be inscribed by the Pharmacist or user. A patient establishes his customized dosage schedule in accordance with prescribed instructions by inscribing 1020 (FIGS. 30, 31) the scheduling indicia by pen or marker or like means.

Assembly of the device is accomplished by bending the support member 1030 at the creases 1042 in a direction that is downward from the front surface 1032. The indicator 1048 is passed through the ring aperture 1026. The retention flap 1056 is then bent upwards and passed through the ring aperture 1026. The ring is lowered to rest on the intact horizontal body 1050 and the retention flap 1056 is released. Inherent spring action returns the flap to substantially its original orientation and the ring is retentively engaged with the support member 1030. The retained ring, which may be freely rotated, is turned to indicate a next dose time period. The lock is bent upwards to clear the retained ring perimeter extension 1014 as the bent portions of the support member are returned to substantially their original orientation. The lock 1060 is then released. Inherent spring action returns the lock to substantially its original orientation trapping the ring extension 1014 and hindering inadvertent rotational displacement of the ring. When assembled, the ring hides most of front surface 1032 of the support member 1030. Co-operating indicia in the assembled device rest in close substantially parallel planes. The device is now attached to medication carton 1140 by way of the pressure sensitive adhesive 1036 on the back surface 1034 of the support member 1030.

When a patient takes her medication she lifts the lock 1060 to clear the ring extension 1014 and rotates the mounted ring to align the inscribed 1020 next dosage time period on the ring 1010 with the next dose pointer 1046 on the support. The lock is then released to trap the selected ring projection. The next dose pointer and the inscribed time period indicia form a reminder indicating when the next dose is due or when the last dose was taken.

Advantages

My dosage reminder device and medication carton, in its various embodiments, has a number of advantages that are evident from the description above. Still other advantages will become apparent upon further consideration:

a) Broad Applicability from a Single Version

My dosage reminder device and medication carton can be used in most current applications that employ a medication carton container. These include cartons manufactured in a wide variety of sizes and wall thickness. Typical cartons could include those containing bottles, tubes, syringes, and blister cards to name a few. The device can be attached by integrally producing the support member in the wall of the container. Alternatively the device can even be attached to the wall surface of a standard pre-existing and erected container containing medication.

b) Low Cost

My invention offers the advantage of very low cost of manufacture. The device may be manufactured at the same time and from the same materials as the medication carton at very little additional cost over that of a standard carton. A ring or indicator could also be produced from the plastic blister card package materials that are commonly used as immediate packaging for some pills. Because the medication carton can serve as one of only two required components to make the device, very little extra material and processing is required. The other component may be economically packed inside the same medication carton for later assembly by the Pharmacist or user. Increased tooling costs are minimal and a single size ring or indicator could be used for all cartons.

c) Ease of Use and Safety

Assembling the device is a simple procedure that could be accomplished by most individuals. The device is simple to use, requiring little skill or dexterity. The device can fit small cartons and still be large enough for easy manipulation and legible indicia. Compliance aids, which separate the medication from the original dispensing container and the directions for use, increase the potential for error. This device works with the original dispensing container. Most medication cartons would also allow placement of the prescription label close to the device.

Every additional step that a patient has to perform in maintaining a medication regimen hinders compliance and increases the potential for error. The device can retain a patient's entire customized dosage schedule. This relieves the need for the patient to reconfirm the next dose time period with the pharmacy label instructions every time a dose is taken. This contrasts sharply with devices that just use standard indicia such as all the days of the week, or all the hours in a day for example. If however, a patient wants to consult the pharmacy prescription label, it is reassuring to be able to view the device and the prescription label instructions at the same time. This arrangement is also less prone to errors. Because the co-operating indicia in my device can rest in close substantially parallel planes, readings taken in use are reliable. Furthermore, unlike compliance aids, such as those on some blister cards, it is not necessary for the user to open the carton in order to make a compliance determination.

d) Customizability

The invention allows for considerable customization of the patient dosage schedule. It is anticipated that two preprinted versions of dosage scheduling indicia could provide sufficient schedule variation capability to suit most patients. I am not aware of any other mass-market compliance aid for medication cartons that offers this degree of cost-effective customization.

Conclusions, Ramifications, and Scope

Thus the reader will see that the dosage reminder device of the invention provides a very simple, effective, yet economical device that can be used by many patients of almost any age.

While my above descriptions contain many specificities, these should not be construed as limitations on the scope of the invention, but rather as exemplifications of embodiments thereof. Many other variations are possible.

For example; the specific shape of the device components may be varied so long as one may be retentively engaged with the other. Also providing that indicia in the device co-operate, and that the movable assembled component may be displaced to a plurality of relative positions. It is contemplated that one member could be debossed while the other member is embossed, and that the co-operating indicia could lie in essentially the same plane.

It is envisioned that many of the embodiments of the invention could, with minor variations, be adapted for mounting on existing medication containers. It is also envisioned that a Pharmacist or user could produce apertures required to assemble the device, and aperture locations could be pre perforated, pre delineated or otherwise indicated.

It is contemplated that the medication carton could have only one or a plurality of somewhat flat walls that would be suitable for attachment of a device member. It is contemplated that the carton and the mounted member could be of a differing wall thickness.

It is additionally contemplated that the device could have other additional means for hindering unwanted displacement of the assembled movable member. While not limited to the following, it could include a friction tab or projection from the carton resting against the mounted member or a projection from one member interlocking with a notch or a depression on the other. It is also contemplated that the movable mounted member could have more or less notches and means other than a notched or serrated perimeter to improve gripping of the member. These could include, but not be limited to a rubber top surface coating, a raised handle, a textured top surface, a fingernail slot, etc.

It is also additionally contemplated that sheet stock used for production of the device members could have raised or lowered surface patterns and a variety of surface finishes and wall structures such as corrugations etc., all while remaining within the scope of equivalence of a flat material for the purposes of the device.

It is further contemplated that the adhesive used in the embodiments of the device in which the device may be attached to a pre-existing container could include, any attaching and bonding means including various chemical adhesives, magnets, and mechanical couplers and fasteners.

It is still further contemplated that the device might be useful in non-medical applications where tasks are repeated at intervals and a simple, inexpensive reminder device would be of help.

Finally, it is contemplated that the dosage time period indicia might indicate times or time periods larger or smaller than those illustrated. Even a different scale might be used to represent members of a set, such as people, places, or things.

Accordingly, the scope of the invention should be determined not by the embodiments illustrated, but by the appended claims and their legal equivalents.

I claim:

1. In a reminder device, the device comprising:

a. co-operating reminding indicia;

b. a support deformable sheet member including a back surface, and a front surface opposing said back surface, said front surface substantially parallel to said back surface, and said support member defining a structural first area for retentive engagement;

c. a movable member, a part of the movable member being a deformable sheet, a surface of the deformable sheet part being a viewing surface for viewing said indicium;

d. said movable member defining a structural first area to retentively receive engagement therewith said structural first area of said support member, and said movable member engageably movable to each of a plurality of selected positions;

e. a portion of said movable member locatable on a portion of said back surface and a portion of the deformable sheet part of said movable member locatable on a portion of said front surface;

f. anti-displacement means for engaging a defined anti-displacement second area of the deformable sheet part with a defined anti-displacement second area of said support member at one of said selected positions to hold said movable member at one of said selected positions, such that a portion of the deformable sheet part proximate to the second area of the deformable sheet part is located on a portion of said front surface;

g. and said movable member adapted for attachment, to an outer cylindrical surface defining a circumference of a container.

2. A device as in claim 1, wherein said support member and said movable member intersect.

3. A device as in claim 1, wherein said co-operating indicia include an array of selectable non-identical values, said values viewable simultaneously prior to selection.

4. A device as in claim 1, wherein at least one of said members includes a material chosen from a list which includes, paper, cardboard, metal, plastic, a material including intrinsic spring action, a patterned material, a surface finished material.

5. A device as in claim 1, wherein said anti-displacement means is one chosen from a list which includes an aperture, a lock, a tab, a friction tab, a spring action, a hinged member, a deformable member.

6. A device as in claim 1, and further including a container.

7. A device as in claim 6, wherein said container is one chosen from a list which includes, a carton, a blister package, a medication container, a pharmacy container.

8. A device as in claim 1, wherein said support member further includes means for attachment to a container.

9. A device as in claim 8 wherein said means for attachment is one chosen from a list which includes an adhesive, a pressure sensitive adhesive, a pattern distributed adhesive.

10. A device as in claim 1, wherein a portion of said back surface is adhered to an article and a portion of said back surface is unadhered to said article.

11. A device as in claim 1, wherein said co-operating indicia include an arrangement of times co-operating with a pointer adapted to point to any one of said times.

12. A device as in claim 1, wherein the deformable sheet part is locatable on said back surface.

13. In a reminder device, the device comprising:

a. a support deformable sheet member including a back surface, and a front surface opposing said back surface, said front surface substantially parallel to said back surface, and said support member defining a structural first area for retentive engagement;

b. a movable deformable sheet including a viewing surface;

c. said movable sheet defining a structural first area to retentively receive engagement therewith said structural first area of said support member, and said movable sheet engageably movable to each of a plurality of selected positions;

d. a portion of said movable sheet locatable on a portion of said back surface and a portion of said movable sheet locatable on a portion of said front surface;

e. anti-displacement means for engaging a defined anti-displacement second area of said movable sheet with a defined and-displacement second area of said support member at one of said selected positions to hold said movable sheet at one of said selected positions, such that a portion of said movable sheet proximate to said second area of said movable sheet is located on a portion of said front surface;

f. and said movable sheet adapted for attachment to an outer cylindrical surface defining a circumference of a container, such that said movable sheet is held at one of said selected positions;

g. said device including co-operating indicia.

14. A device as in claim 13, wherein said co-operating indicia include an array of selectable non-identical values, said values viewable simultaneously prior to selection and said movable sheet is a part of a sheet member of said device.

15. A device as in claim 13, wherein at least one of said members includes a material chosen from a list which includes, paper, cardboard, metal, plastic, a material including intrinsic spring action, a patterned material, a surface finished material.

16. A device as in claim 13, wherein said anti-displacement means is one chosen from a list which includes an aperture, a lock, a tab, a friction tab, a spring action, a hinged member, a deformable member.

17. A device as in claim 13, wherein said support member further includes means for attachment to an article.

18. A device as in claim 17, wherein said means for attachment is one chosen from a list which includes an adhesive, a pressure sensitive adhesive, a pattern distributed adhesive.

19. A device as in claim 17, wherein said article is a container chosen from a list which includes, a carton, a blister package, a medication container, a pharmacy container.

20. A device as in claim 13, wherein said co-operating indicia include an arrangement of times co-operating with a pointer adapted to point to any one of said times.

21. A device as in claim 13, wherein a portion of said back surface is adhered to an article and a portion of said back surface is unadhered to said article.

22. A method of providing a reminder, comprising:

a. providing a support deformable sheet member attachable to a container, the support member including a back surface, and a front surface opposing the back surface, the front surface substantially parallel to the back surface, and the support member defining a structural first area for retentive engagement, and the support member defining a second area for anti-displacement engagement;

b. providing a movable member attachable to an outer cylindrical surface defining a circumference of the container, a part of the movable member being a deformable sheet, a surface of the deformable sheet being a viewing surface, and the movable member defining a structural first area to retentively receive engagement therewith the structural first area of the support member, and the movable member engageably movable to each of a plurality of selected positions, and the deformable sheet part defining a second area to anti-displaceably receive engagement therewith the second area of the support member, where the support member and the movable member include co-operating reminding indicia, and whereby;

c. engaging the first area of the movable member with the first area of the support member retains the movable member such that a portion of the movable member is located on a portion of the back surface and a portion of the deformable sheet part is located on a portion of the front surface;

d. and such that moving the movable member while the first area of the movable member is engaged with the first area of the support member, to select a position whereby the co-operating indicia indicate a desired reminder;

e. and such that engaging the second area of the deformable sheet part with the second area of the support member, locates the deformable sheet part such that a portion of the deformable sheet part proximate to the second area of the deformable sheet part is located on a portion of the front surface, and such that the movable member is held at the selected position.

23. A method as in claim 22, wherein said co-operating reminding indicia include an arrangement of times.

* * * * *